US011542882B2

(12) United States Patent
Liu et al.

(10) Patent No.: US 11,542,882 B2
(45) Date of Patent: Jan. 3, 2023

(54) METHOD AND SYSTEM FOR CORRECTING ERRORS IN FUELING COMMANDS

(71) Applicant: Cummins Inc., Columbus, IN (US)

(72) Inventors: Yilun Liu, Columbus, IN (US); Carlos A. Lana, Columbus, IN (US)

(73) Assignee: Cummins Inc., Columbus, IN (US)

( * ) Notice: Subject to any disclaimer, the term of this patent is extended or adjusted under 35 U.S.C. 154(b) by 48 days.

(21) Appl. No.: 16/988,060

(22) Filed: Aug. 7, 2020

(65) Prior Publication Data

US 2021/0040909 A1 Feb. 11, 2021

Related U.S. Application Data

(60) Provisional application No. 62/884,456, filed on Aug. 8, 2019.

(51) Int. Cl.

| | |
|---|---|
| ***F02D 41/00*** | (2006.01) |
| ***F02D 41/14*** | (2006.01) |
| ***F02D 41/18*** | (2006.01) |
| ***F02D 41/24*** | (2006.01) |
| *F02D 1/00* | (2006.01) |

(52) U.S. Cl.

CPC ..... *F02D 41/1402* (2013.01); *F02D 41/1458* (2013.01); *F02D 41/182* (2013.01); *F02D 41/2454* (2013.01); *F02D 2001/009* (2013.01); *F02D 2041/1433* (2013.01)

(58) Field of Classification Search

CPC ..... F02D 41/1402; F02D 41/1458; F02D 41/182; F02D 41/2454; F02D 2001/009; F02D 2041/1433

See application file for complete search history.

(56) References Cited

U.S. PATENT DOCUMENTS

| | | | | |
|---|---|---|---|---|
| 5,755,212 | A * | 5/1998 | Ajima | F02D 41/1405 123/674 |
| 8,219,302 | B2 * | 7/2012 | Yamashita | F02D 41/3094 701/106 |
| 8,573,185 | B2 * | 11/2013 | Miura | F02D 41/22 123/458 |
| 2010/0132681 | A1 * | 6/2010 | Okazaki | F02D 41/1456 123/703 |

* cited by examiner

*Primary Examiner* — Gonzalo Laguarda

(74) *Attorney, Agent, or Firm* — Taft, Stettinius & Hollister LLP

(57) ABSTRACT

A method and system is provided for correcting fueling commands. For example, the method and system may calibrate an engine operating in a steady-state mode by determining a plurality of accuracy errors associated with a fueling rate based on a plurality of sensor measurements. The method and system may determine fueling rate correction data during on-line operation of the engine based on the plurality of accuracy errors. The on-line operation of the engine may comprise operating the engine in a transient mode at a first period of time and a steady-state mode at a second period of time. The method and system may control at least one fueling valve during operation of the engine using a corrected fueling command. The corrected fueling command is based on the fueling rate correction data.

20 Claims, 11 Drawing Sheets

200

300

METHOD AND SYSTEM FOR CORRECTING ERRORS IN FUELING COMMANDS

CROSS-REFERENCE TO RELATED APPLICATIONS

The present application claims priority to U.S. patent application Ser. No. 62/884,456, filed Aug. 8, 2019, the entire disclosure of which being expressly incorporated herein by reference.

FIELD OF THE DISCLOSURE

The present disclosure generally relates to fueling systems and more specifically to adjusting fueling commands to correct fueling rate errors.

BACKGROUND OF THE DISCLOSURE

In power generation systems, the engine combusts fuel provided by the fuel system using an oxidant, such as oxygen, to provide energy that drives the generator. Specifically, an engine controller (e.g., an electronic control module (ECM)) monitors a plurality of system operating parameters via various sensors and interprets a subset of the monitored parameters, such as engine speed, mass air flow rate, etc., to determine the fueling command that indicates desired amount of fuel to be injected. Fuel is then metered by the fuel system based on the fueling command and mixed with air stream aspirated by the engine. The air/fuel mixture is then transported through the air intake and finally ignited by sparks in power cylinders to generate power through its combustion.

Ideally, the actual fueling resulting from the fueling commands should maintain the lambda (i.e., the air to fuel ratio normalized by the stoichiometric air/fuel ratio) of the mixture at its target to achieve varying engine operation requirements. However, uncertainties in generating fueling commands in various operating conditions as well as uncertainties in the fuel system, and other factors may result in actual fueling varying from its desired amount.

Typically, the errors in actual fueling are absorbed and accounted for using a closed-loop lambda control in which the lambda target is compensated by a closed-loop controller, such as a proportional-integral-derivative (PID) controller. The closed-loop lambda controller measures the lambda via a lambda sensor and then generates a compensated lambda target through the comparison between the desired and measured lambda. The compensated lambda target, typically deviated from the original target, is used to cancel out the errors in actual fueling such that lambda can still be maintained at its original target in steady state even with fueling uncertainties.

However, in some examples, the measurements from the lambda sensor may be unavailable and thus lambda control only relies on a feed-forward control manner. For example, lambda measurements are typically unavailable during cranking (e.g., starting the engine) as the sensor requires time to warm up before it can provide an output. In the feed-forward control examples, the lambda target may be generated by pre-calibrated look-up tables and might not be compensated by the closed-loop controller. As a result, the uncertainties in fueling may result in steady-state errors in lambda tracking, and thus either preventing the engine from starting on time or, in the worst case, not starting at all. In this regard, there remains a need for providing systems and methodologies to address these and other shortcomings of the uncertainty-induced fueling errors, especially in feed-forward lambda control scenarios.

SUMMARY OF THE DISCLOSURE

In the one or more embodiments, a system may determine one or more corrected fueling commands, such as by substituting/altering conventional fueling commands (e.g., nominal fueling command) with fueling rate correction data (e.g., one or more adaptive correction terms). The corrected fueling commands are used to control the fuel valves within the system. The change on the nominal fueling command made by the fueling rate correction data are used to compensate for the errors in fueling that may be induced by related accuracy errors (e.g., fueling uncertainties). The accuracy errors may be identified based on the determination of nominal fueling commands. Then, the values of the accuracy errors may be estimated using a steady state mode (e.g., off-line engine calibration method) in which the steady-state errors in lambda are compared with the identified accuracy errors in various engine operating conditions. After the off-line calibration, the fueling rate correction data are computed to correct the nominal fueling commands in real-time engine operation. The final form of the fueling rate correction data may depend on the estimated accuracy errors and/or related sensor readings. Further, the fueling rate correction data might not depend on the lambda measurements. In other words, they can be used to effectively eliminate or reduce the steady state error in lambda induced by fueling accuracy errors even when lambda feedback is unavailable in some scenarios. Additionally, and/or alternatively, in some examples, gradient-based approach may be employed to determine the structure of the fueling rate correction data through analyzing the relations between them and the identified accuracy errors.

In some instances, the corrected fueling may be used for feed-forward lambda control scenarios in which it is used to reduce the steady state error in lambda induced by fueling accuracy errors when lambda measurement is not available. In other instances, it may be used with closed-loop lambda controls in which it is expected to improve the transient performance of lambda tracking as it generates more accurate fueling commands compared to nominal ones.

In some embodiments, the present disclosure provides a system and method for correcting fueling commands. For example, the system may include a controller configured to perform the method. The method may comprise calibrating, by a controller, an engine operating in a steady-state mode by determining a plurality of accuracy errors associated with a fueling rate based on a plurality of measurements associated with a lambda sensor, determining fueling rate correction data during on-line operation of the engine based on the plurality of accuracy errors from calibrating the engine, wherein the on-line operation of the engine comprises operating the engine in a transient mode at a first period of time and the steady-state mode at a second period of time, and controlling at least one fueling valve during on-line operation of the engine using a corrected fueling command, wherein the corrected fueling command is based on the fueling rate correction data.

In some instances, the method may comprise calibrating the engine by providing one or more commands to cause the engine to operate at a plurality of operating parameters, receiving the plurality of measurements, wherein each measurement corresponds to a different operating parameter of the plurality of operating parameters, and calculating the plurality of accuracy errors based on the plurality of measurements. In some examples, the method may comprise receiving the plurality of measurements from the lambda sensor.

In some variations, the at least one of the plurality of accuracy errors may include a charge estimation gain error, a charge estimation offset error, an intake manifold pressure (IMP) sensing gain error, an IMP sensing offset error, an intake manifold temperature (IMT) sensing gain error, an IMT sensing offset error, a first valve fueling gain error, a second valve fueling gain error, a total fueling offset error, and/or a stoichiometric air fuel ratio (AFR) offset error.

In some instances, the fueling rate correction data comprises a first fueling rate correction value and a second fueling rate correction value. The method may further comprise determining the first fueling rate correction value based on a desired lambda value, the plurality of accuracy errors, a nominal stoichiometric air fuel ratio, and a secondary fueling rate command ratio that is set to zero, and determining the second fueling rate correction value based on the desired lambda value, the plurality of accuracy errors, the nominal stoichiometric air fuel ratio, and the secondary fueling rate command ratio that is set to one.

In some examples, the corrected fueling command comprises a first corrected fueling command defined by $$\hat{\dot{m}}^*_{f1} = \hat{\dot{m}}_{f1}\left(1 + \frac{\widehat{AFR}_S}{1 + \lambda_{des}\widehat{AFR}_S}\Phi(r = 0)\Theta'\right),$$

wherein $\hat{\dot{m}}^*_{f1}$ is the first corrected fueling command, $\hat{\dot{m}}^*_{f1}$ is a first fueling command based on a desired lambda value, $\widehat{AFR}_S$ is a nominal stoichiometric air fuel ratio, $\lambda_{des}$ is a desired lambda, $\phi(r=0)$ are a set of coefficients with a secondary fueling rate command ratio set to zero, and $\Theta'$ are the plurality of accuracy errors.

In some instances, the corrected fueling command comprises a second corrected fueling command defined by $$\hat{\dot{m}}^*_{f2} = \hat{\dot{m}}_{f2}\left(1 + \frac{\widehat{AFR}_S}{1 + \lambda_{des}\widehat{AFR}_S}\Phi(r = 1)\Theta'\right),$$

wherein $\hat{\dot{m}}^*_{f2}$ is the second corrected fueling command, $\hat{\dot{m}}^*_{f2}$ is a second fueling command based on a desired lambda value, $\widehat{AFR}_S$ is a nominal stoichiometric air fuel ratio, $\lambda_{des}$ is a desired lambda, $\phi(r=1)$ are a set of coefficients with a secondary fueling rate command ratio set to one, and $\Theta'$ are the plurality of accuracy errors.

While multiple embodiments are disclosed, still other embodiments of the present disclosure will become apparent to those skilled in the art from the following detailed description, which shows and describes illustrative embodiments of the present disclosure. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
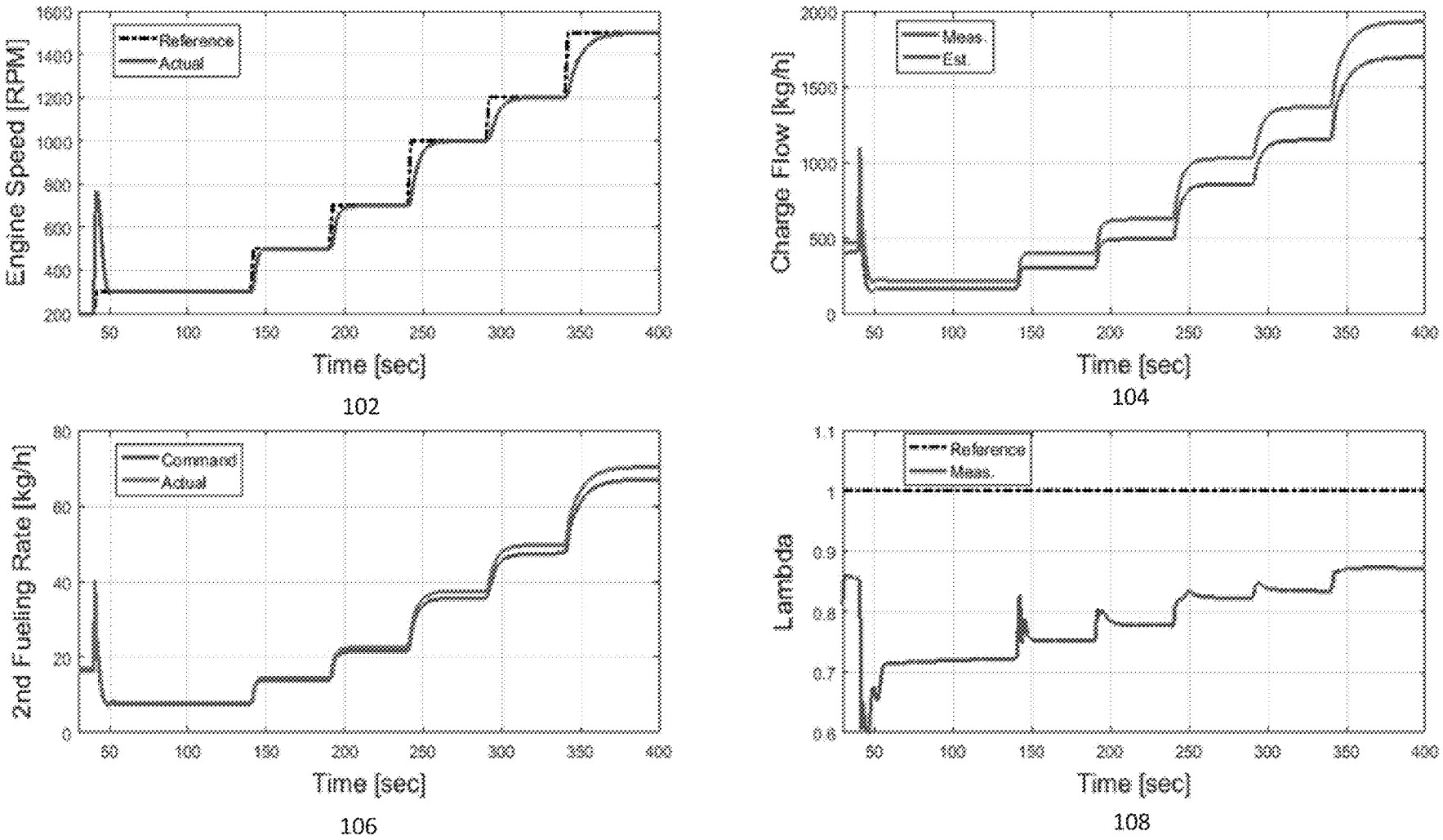
FIG. 1 PRIOR ART
FIG. 1 show graphical representations of lambda tracking subjected to fueling accuracy errors using nominal fueling commands.

While the present disclosure is amenable to various modifications and alternative forms, specific embodiments have been shown by way of example in the drawings and are described in detail below. The intention, however, is not to limit the present disclosure to the particular embodiments described. On the contrary, the present disclosure is intended to cover all modifications, equivalents, and alternatives falling within the scope of the present disclosure as defined by the appended claims.

DETAILED DESCRIPTION OF THE DISCLOSURE

In the following detailed description, reference is made to the accompanying drawings which form a part hereof, and in which is shown by way of illustration specific embodiments in which the present disclosure is practiced. These embodiments are described in sufficient detail to enable those skilled in the art to practice the present disclosure, and it is to be understood that other embodiments can be utilized and that structural changes can be made without departing from the scope of the present disclosure. Therefore, the following detailed description is not to be taken in a limiting sense, and the scope of the present disclosure is defined by the appended claims and their equivalents.

In the current state of the art, traditional fueling commands (e.g., nominal fueling commands) are determined based on the estimated charge/air flow rate, the stoichiometric air-fuel ratio, the lambda setpoint, etc., without considering fueling accuracy errors. For example, the relation between λ target and the nominal fueling command may be given by:

$$\lambda_{des} = \frac{\hat{\dot{m}}_c - \hat{\dot{m}}_f}{\hat{\dot{m}}_f * \widehat{AFR}_S} = \frac{1}{\widehat{AFR}_S}\left(\frac{\hat{\dot{m}}_c}{\hat{\dot{m}}_f} - 1\right) \tag{1}$$

where $\lambda_{des}$ is λ target, $\hat{\dot{m}}_c$ is the estimated charge flow, $\hat{\dot{m}}_f$ is the nominal fueling command, $\widehat{AFR}_S$ is the nominal Air Fuel Ratio (AFR). The symbol hat (ˆ)over parameters herein stands for estimation, sensor readings, or commands, which are observables but typically deviated from their true values. $\lambda_{des}$ is the compensated lambda target if the system has the closed-loop lambda control and the original target if the lambda measurement is unavailable. The charge flow may be estimated by the speed density equation shown below:

$$\hat{m}_c = C * \frac{\hat{\eta}_{vol}\hat{N}_e\hat{P}_{im}}{\hat{T}_{im}} \tag{2}$$

where $\hat{N}_e$ is the measured engine speed, $\hat{P}_{im}$ and $\hat{T}_{im}$ are measured intake manifold pressure (IMP) and temperature (IMT), $\hat{\eta}_{vol}$ is the estimated volumetric efficiency (Vol. Eff.) and C is a constant given by:

$$C = \frac{D}{120R} \tag{3}$$

where D is the engine displacement and R is the gas constant of the charge mixture. Based on equation (Eq.) (1), the nominal fueling command may be calculated by:

$$\hat{m}_f = \frac{\hat{m}_c}{1 + \lambda \widehat{AFR}_S} \tag{4}$$

Ideally, the actual fueling resulting from the nominal fueling commands $\hat{m}_f$ should maintain the actual lambda at its target $\lambda_{des}$. However, accuracy errors in nominal fueling commands for various operating conditions as well as in various fuel systems, and other factors may result in actual fueling varying from its desired amount. As explained below, the accuracy errors in generating fueling commands include the air estimation error caused by an imperfect air/charge estimation model, the sensing drifts of related signals, and others. Such accuracy errors may cause a deviation between the desired fueling and fueling commands. The accuracy errors (e.g., uncertainties) in the fuel system (e.g., a pressurized fuel supply and/or fuel control valve(s)) include part-to-part variation of fuel control valves, Gas Mass Flow (GMF) sensing drifts and others, which may cause the errors between fueling commands and actual fueling. In short, the nominal fueling commands $\hat{m}_f$ in Eq. (4) might not be adaptive to the above accuracy errors in fueling generation and thus lambda tracking performance may be degraded if fueling accuracy errors exist.

Figure 3:
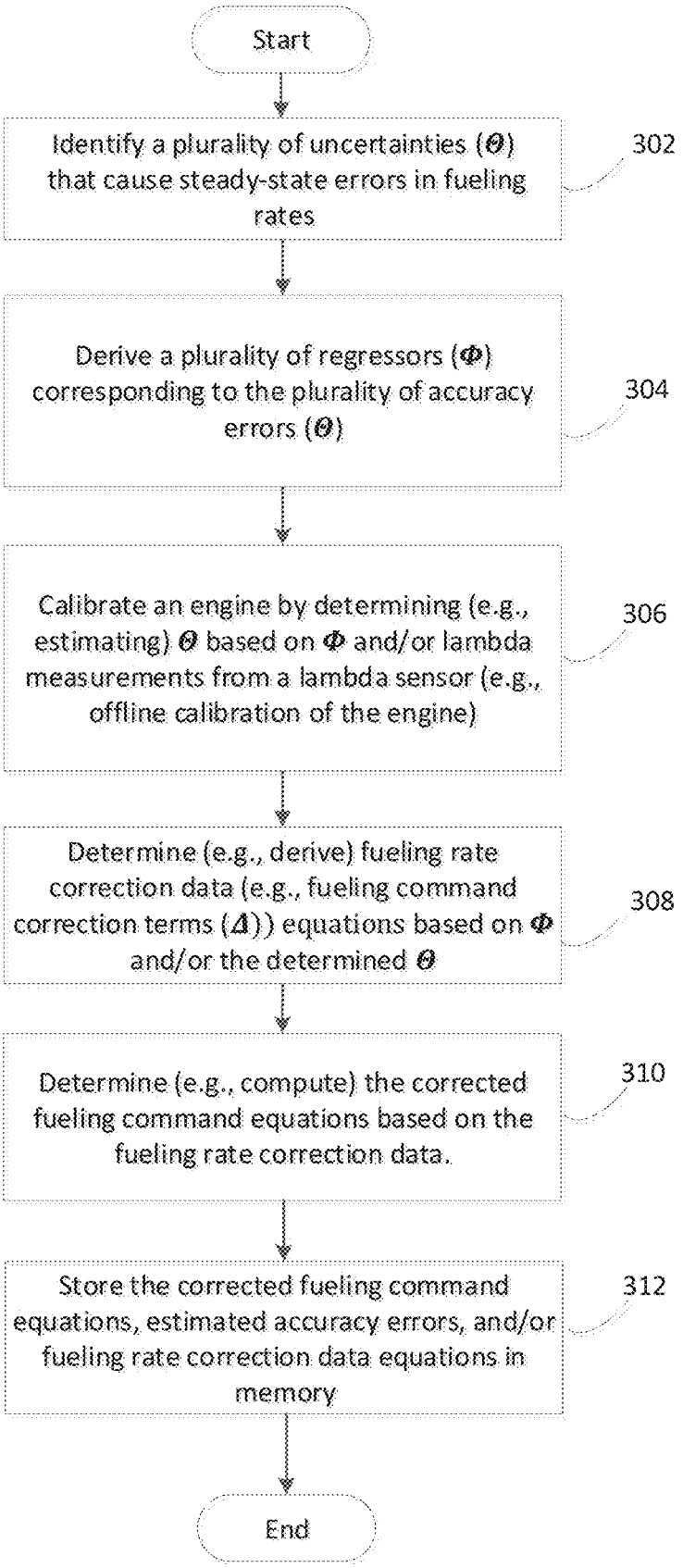
FIG. 3 shows a flow chart illustrating a method for correcting fueling rates in accordance with one or more embodiments set forth in the disclosure.
Figure 4:
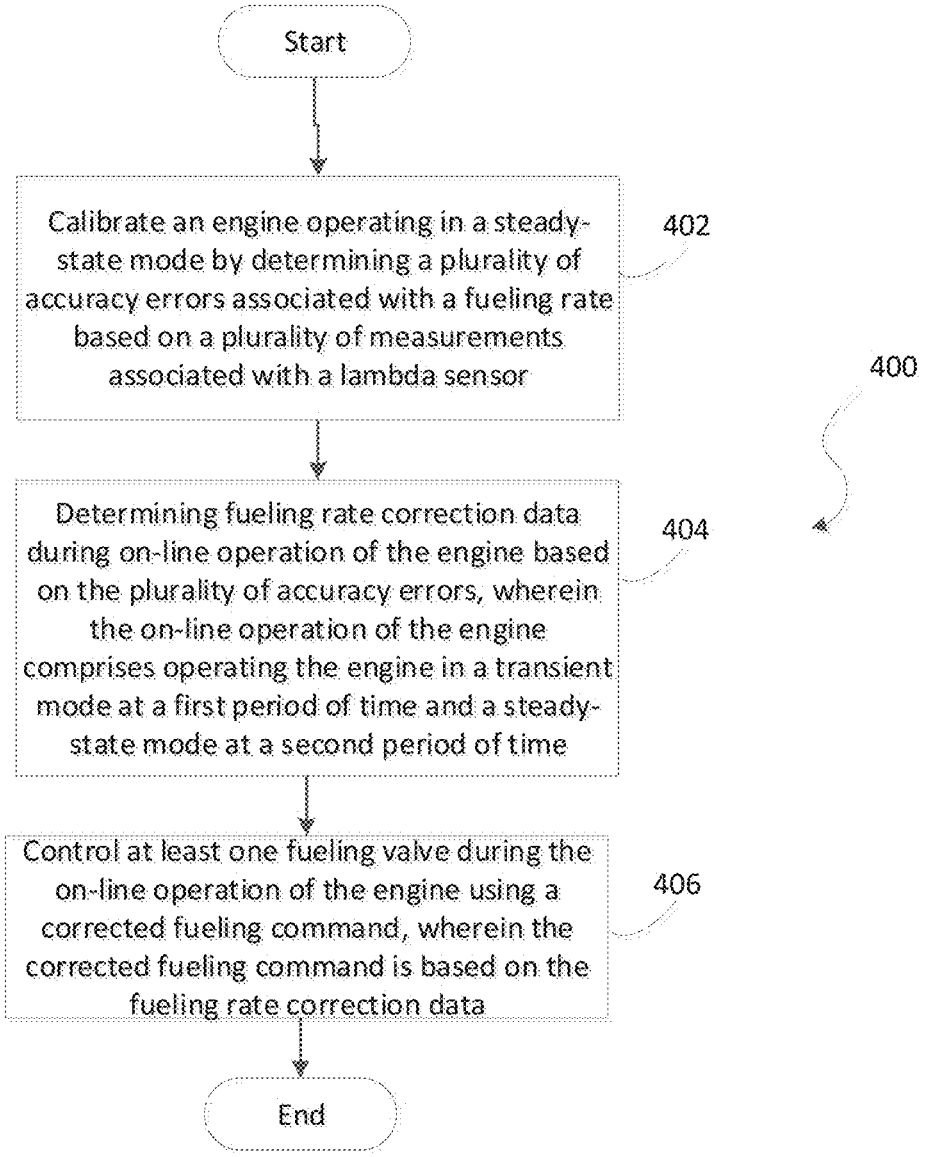
FIG. 4 shows another flow chart illustrating real time execution for correcting fueling rates in accordance with one or more embodiments set forth in the disclosure.

For example, FIG. 1 shows the effect of accuracy errors when using a traditional prior art fueling system with feedforward AFR controls. In this system, an IMP sensing error=+10 kPa and a fueling error=+5% are artificially added in the nominal fueling command generation for various engine speeds. Graph 102 shows the engine speed profile. Graph 104 shows the overestimated charge flow when the IMP sensing error is +10 kpa. Graph 106 shows the fueling error, in which actual fueling is 5% larger than its fueling command. Because of the fueling accuracy errors, the error between actual lambda and its desired value is significant, as shown by graph 108. As such, a new fueling system and method illustrated by FIGS. 2-4 are used to replace the nominal fueling command and compensate for the accuracy errors such that the actual fueling rates maintain the target $\lambda_{des}$.

Figure 2:
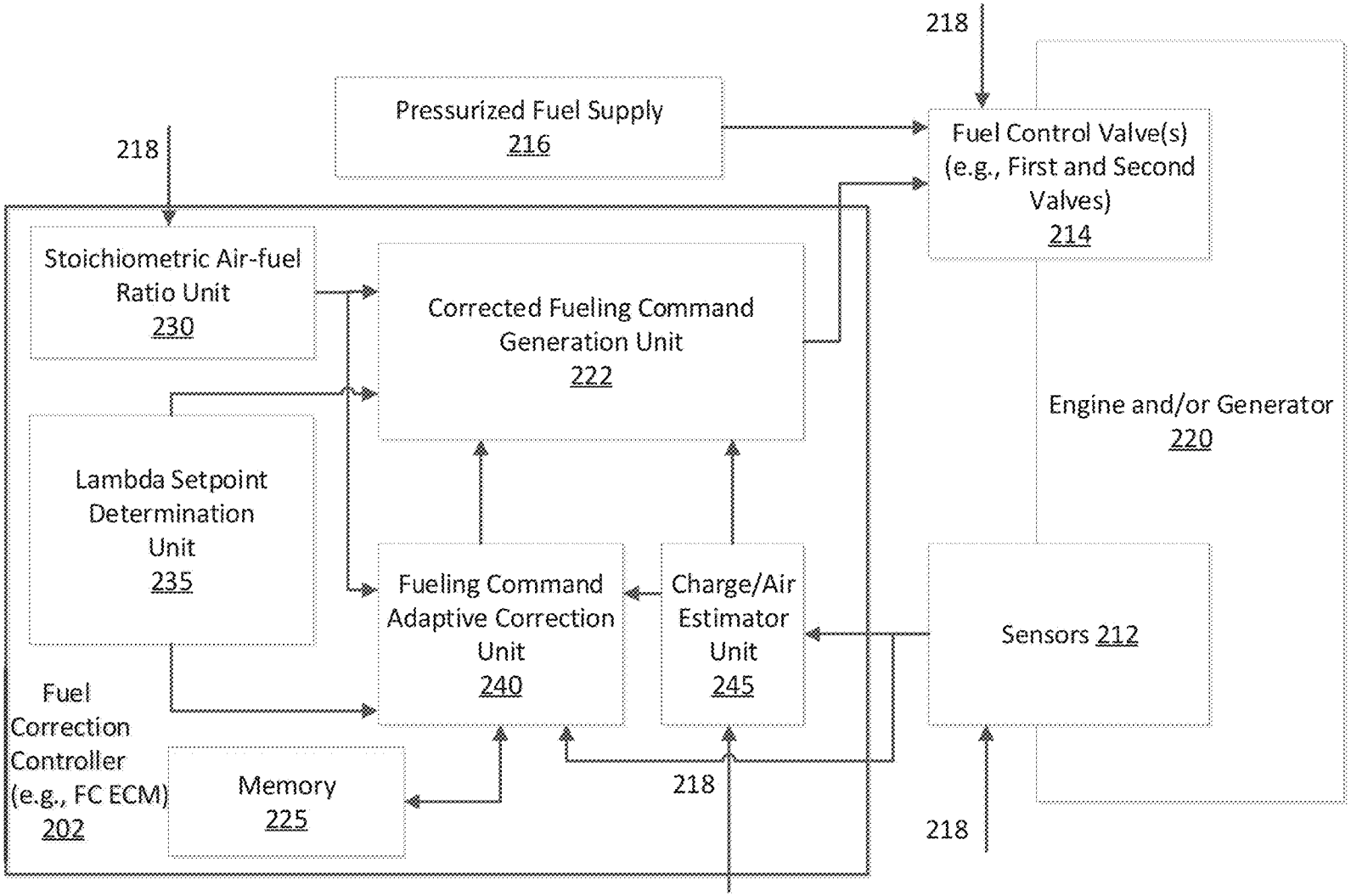
FIG. 2 shows a schematic block diagram illustrating a system for correcting fueling rates in accordance with one or more embodiments set forth in the disclosure.

FIG. 2 shows an exemplary system 200 for correcting nominal fueling commands by counteracting the effect of the accuracy errors in the nominal fueling commands. For example, the system 200 may include an engine and/or generator 220, a fuel correction controller 202 (e.g., a fuel correction engine control module (FC ECM)), and/or a pressurized fuel supply 216. The engine and/or generator 220 may include sensors 212 and/or one or more fuel control valve(s) 214 (e.g., first and second valves). The controller 202 may include one or more units such as a stochiometric air-fuel ratio unit 230, a lambda setpoint determination unit 235, a charge/air estimator unit 245, fueling command adaptive correction unit 240, memory 225, and/or a corrected fueling command generation unit 222.

The pressurized fuel supply 216 may provide fuel, such as gasoline, natural gas, diesel fuel, to the engine and/or generator 220. An exemplary fueling system is described in International Application No. PCT/US2017/058078, titled FUEL PUMP PRESSURE CONTROL STRUCTURE AND METHODOLOGY, filed Oct. 24, 2017, the entire disclosure of which is hereby incorporated by reference. One or more components within the system 200 (e.g., sensors 212, unit 245, unit 230, and/or the fueling control valves 214) may be subjected to fueling accuracy errors 218 as will be explained below.

The engine and/or generator 220 may be any suitable type of system that generates power for a load. For example, the engine and/or generator 220 may be a power generator (PowerGen) system. The engine and/or generator 220 may receive fuel from a fueling system (e.g., a pressurized fuel supply 216) and combust fuel as is known in the art. Using the combustion process, the engine and/or generator 220 may provide power to the load. The load may be a device, system, and/or other type of entity that uses the energy from the combustion process to perform tasks. In some examples, the engine may be a diesel engine and the fuel may be diesel fuel.

The controller 202 may be any suitable type of module, apparatus, system, processor, or device suitable for implementing aspects of embodiments of the disclosed subject matter. Examples of the controller 202 may include, but are not limited to one or more workstations, servers, cloud computing platforms, laptops, desktops, tablet computers, hand-held devices, general-purpose units, state machines, APUs, CPUs, GPUs, engine control modules (ECMs), engine control units (ECUs), and the like, all of which are contemplated within the scope of the controller 202.

The controller 202 may include and/or use one or more units such as a stochiometric air-fuel ratio unit 230, a lambda setpoint determination unit 235, a fueling command adaptive correction unit 240, a charge/air estimator unit 245, and/or a fueling command generation unit 222. The stochiometric air-fuel ratio unit 230 may determine a stochiometric air-fuel ratio based on fuel type and quality. The lambda setpoint determination unit 235 may determine a lambda setpoint based on application needs. If a closed-loop lambda method is used, unit 235 may output a compensated lambda setpoint. The fueling command adaptive correction unit 240 may compute fueling correction data in real time and send them to the fueling command generation unit 222 for the computation of corrected fueling commands. The charge/air estimator unit 245 may estimate charge/air flow for the fueling command calculation. The units 222, 230, 235, 240, and/or 245 may be used by the controller 202 to receive information from one or more sensors 212, correct the fueling commands, and/or control operation of the engines and/or generators 220. As used herein, the term "unit" refers to, be part of, or include an Application Specific Integrated Circuit (ASIC), an electronic circuit, a processor or microprocessor (shared, dedicated, or group) and/or memory (shared, dedicated, or group) that executes one or more software or firmware programs, a combinational logic circuit, and/or other suitable components that provide the described functionality. In some examples, these units 222, 230, 235, 240, and/or 245 may be operated as separate units. In other examples, the functionalities of one or more of these units 222, 230, 235, 240, and/or 245 may be combined together (e.g., a single unit, such as a fuel correction unit, is used to perform the methods described herein).

In some examples, the controller 202 may include memory 225. Memory 225 may be RAM, ROM, or any other suitable memory and/or medium. In some examples, the memory 225 includes computer-executable instructions that when executed cause a processor (e.g., the controller 202 and/or one or more processors within the controller 202) to cause the controller 202 to implement aspects of embodiments as discussed herein and/or to perform aspects of embodiments of methods and procedures discussed herein.

The controller 202 may be in communication with and/or control one or more systems, apparatuses and/or devices within the system 200. For example, as will be explained below, the controller 202 may be configured to generate fueling commands by correcting for fueling accuracy errors 218 within the system 200. The controller 202 may also be configured to receive information and/or control operation of the engine and/or generator 220.

The engine and/or generator 220 may include one or more fuel valves. The controller 202 may provide one or more corrected fueling commands indicating one or more fueling rates to the fueling system 220. The fueling system 220 may provide fuel to the engine and/or generator 220 based on the fueling commands. The corrected fueling command may be determined by altering the nominal fueling command with fueling rate correction data (e.g., correction terms) given below:

$$\hat{\dot{m}}^*_f = \hat{\dot{m}}_f((1+\Delta_f) \tag{5}$$

where $\hat{\dot{m}}^*_f$ is the corrected fueling command, $\Delta_f$ is the fueling rate correction data, and $\hat{\dot{m}}_f$ is the nominal fueling command, such as the one given by Eq. 4. In a multi-valve engine system, the fueling rate correction data may include multiple correction terms with each term altering a respective nominal fueling command corresponding to each fuel valve. For the system with n fuel valves:

$$\hat{\dot{m}}^*_f = \begin{bmatrix} \hat{\dot{m}}^*_{f1} & & & \\ & \hat{\dot{m}}^*_{f2} & & \\ & & \ddots & \\ & & & \hat{\dot{m}}^*_{fn} \end{bmatrix} \tag{6a}$$

$$\hat{\dot{m}}_f = \begin{bmatrix} \hat{\dot{m}}_{f1} & & & \\ & \hat{\dot{m}}_{f2} & & \\ & & \ddots & \\ & & & \hat{\dot{m}}_{fn} \end{bmatrix} \tag{6b}$$

$$\Delta_f = \begin{bmatrix} \Delta_{f1} & & & \\ & \Delta_{f2} & & \\ & & \ddots & \\ & & & \Delta_{fn} \end{bmatrix} \tag{6c}$$

where $\hat{\dot{m}}^*_{fj}$, $\hat{\dot{m}}^*_{fj}$, $\Delta_{fj}$, j=1,2 . . . n are the corrected fueling command, nominal fueling command, fueling rate correction data for each fuel valve, respectively. The change on the nominal fueling command made by the adaptive correction term $\hat{\dot{m}}^*_f\Delta_f$ is intended to compensate the errors in fueling induced by accuracy errors.

FIG. 3 shows an exemplary flowchart (e.g., method) 300 which may be used by the controller 202 to determine the fueling rate correction data $\Delta_f$ and the corresponding corrected fueling commands $\hat{\dot{m}}^*_f$. At step 302, the controller 202 identifies a plurality of accuracy errors (Θ). In some instances, a developer may input the accuracy errors and the controller 202 may receive the user input indicating the accuracy errors. The plurality of accuracy errors may cause steady-state errors in fueling rates (e.g., errors in fueling rates during real-time operation of an engine such as when the engine 220 is producing power to a load). The plurality of accuracy errors may include charge flow accuracy errors (e.g., charge flow estimation errors), sensor accuracy errors (e.g., measurement accuracy errors of a pressure sensor and/or a temperature sensor), fuel system accuracy errors (e.g., fueling accuracy errors,), and/or others.

For example, the accuracy errors in fueling may be identified based on and/or using a fueling uncertainty model introduced below:

$$\lambda_{meas} = \frac{\dot{m}_c - \dot{m}_f}{\dot{m}_f * AFR_s} = \frac{1}{AFR_s}\left(\frac{\dot{m}_c}{\dot{m}_f} - 1\right) \tag{7}$$

where $\lambda_{meas}$ is measured by lambda sensors and assuming the lambda measurement is accurate during steady state, $\dot{m}_c$ is the true charge flow rate, $\dot{m}_f$ is the actual fueling, $AFR_s$ is the true AFR.

The fueling accuracy errors of a two fuel-valves engine are analyzed below as an illustrating example. The analysis may be similarly performed or extended to any engine systems including multi-valve engines. In the illustrating example, a charge flow uncertainty model may be introduced below:

$$\dot{m}_c = (1+\Delta G_{\dot{m}_c})\dot{m}'_c + \Delta B_{\dot{m}_c} \tag{8}$$

where a gain error $\Delta G_{\dot{m}_c}$ and an offset error $\Delta B_{\dot{m}}$ are introduced to model the inaccuracy of the charge flow estimation, and $$\dot{m}'_c = C * \frac{\eta_{vol} N_e P_{im}}{T_{im}} \tag{9}$$

where $P_{im}$ and $T_{im}$ are the true pressure and temperature possibly deviated from their sensor readings due to sensor drifts, degradation, etc. The sensor accuracy errors may be modeled below, $$P_{im} = (1+\Delta G_{P_{im}})\hat{P}_{im} + \Delta B_{P_{im}} \tag{10}$$

$$T_{im} = (1+\Delta G_{T_{im}})\hat{T}_{im} + \Delta B_{T_{im}} \tag{11}$$

where gain errors $\Delta G_{P_{im}}$ and $\Delta G_{T_{im}}$ and offset errors $\Delta B_{P_{im}}$ and $\Delta B_{T_{im}}$ are introduced to model the accuracy errors of pressure and temperature measurement. In the illustrating example, the measurement of engine speed $N_e$ is assumed to be accurate.

$$N_e = \hat{N}_e \tag{12}$$

Using true signal values, the actual volumetric efficiency in the illustrating example maybe estimated by the model below $$\eta_{vol} = (a_0 + a_1 N_e + a_2 P_{im} + a_3 N_e^2 + a_4 P_{im}^2 + a_5 N_e P_{im}) * (a_6 + a_7 T_{im} + a_8 T_{im}^2) \tag{13}$$

where $a_i$ are the model coefficients to be calibrated.

The fuel system may include another set of accuracy errors. For example, in a two-valve system, the total nominal fueling commands are the summation of the fueling commands of the two individual valves.

$$\hat{\dot{m}}_f = \hat{\dot{m}}_{f1} + \hat{\dot{m}}_{f2} = \frac{\hat{\dot{m}}_c}{1 + \lambda_{des}\widehat{AFR}_S} \tag{14}$$

A parameter, named $2^{nd}$ fueling ratio, is defined $$r = \frac{\hat{\dot{m}}_{f2}}{\hat{\dot{m}}_f} \tag{15}$$

With the introduced r, the nominal fueling commands of the $1^{st}$ and $2^{nd}$ fuel valves may be re-written as $$\hat{\dot{m}}_{f1}=(1-r)\hat{\dot{m}}_f \tag{16}$$

$$\hat{\dot{m}}_{f2}=r^*\hat{\dot{m}}_f \tag{17}$$

The accuracy errors and the fueling rate correction in the $1^{st}$ fueling may be modeled as $$\dot{m}_{f1}=(1+\Delta G_{\dot{m}_{f1}})\hat{\dot{m}}_{f1}(+\Delta_{f1})+\Delta B_{\dot{m}_{f1}} \tag{18}$$

where $\dot{m}_{f1}$ is the actual fueling of the $1^{st}$ fuel valve, $\Delta G_{\dot{m}_{f1}}$ and $\Delta B_{\dot{m}_{f1}}$ are the introduced gain error and offset error between the fueling command and actual fueling. $\Delta_{f1}$ is the fueling rate correction term for the $1^{st}$ fueling command and therefore the corrected $1^{st}$ fueling command $\hat{\dot{m}}_{f1}$ is given by $$\hat{\dot{m}}_{f1}=\hat{\dot{m}}_{f1}(1+\Delta_{f1}) \tag{19}$$

The accuracy errors and the fueling rate correction in the $2^{nd}$ fueling may be modeled as $$\hat{\dot{m}}_{f2}=(1+\Delta G_{\dot{m}_{f2}})\hat{\dot{m}}_{f2}(1+\Delta_{f2})+\Delta B_{\dot{m}_{f2}} \tag{20}$$

where $\dot{m}_{f2}$ is the actual fueling of the $2^{nd}$ fuel valve, $\Delta G_{\dot{m}_{f2}}$ and $\Delta B_{\dot{m}_{f2}}$ are the introduced gain error and offset error between the fueling command and actual fueling of the $2^{nd}$ fuel valve. $\Delta_{f2}$ is the fueling rate correction term for the $2^{nd}$ fueling command and therefore the corrected $2^{nd}$ fueling command $\hat{\dot{m}}^*_{f2}$ is given by $$\hat{\dot{m}}_{f2}=\hat{\dot{m}}_{f2}\ (1+\Delta_{f2}) \tag{21}$$

The actual total fueling is then obtained by combining Eqs. (18) and (20), given below $$\dot{m}_f=\hat{\dot{m}}_f((1-r)(1+\Delta G_{\dot{m}_{f1}})(1+\Delta_{f1})+r(1+\Delta G_{\dot{m}_{f2}})(1+\Delta_{f2}))+\Delta B_{\dot{m}_{f1}}+\Delta B_{\dot{m}_{f2}} \tag{22}$$

In Eq. 22, $\hat{\dot{m}}_f$ is the nominal total fueling command and its deviation from actual total fueling is caused by the coupled effect of the accuracy errors and fueling rate correction data of the two fuel valves. In addition, fuel quality uncertainty may be modeled by $$AFR_s = \widehat{AFR}_S + \Delta B_{AFR_s} \tag{23}$$

where an offset error $\Delta B_{AFR_s}$ is introduced to model the error between nominal and true AFR.

In the illustrating example, ten fueling accuracy errors are introduced and fueling rate correction data includes two fueling rate corrections that are proposed to cancel out the effect of the accuracy errors in resulting in fueling and lambda tracking errors. Table 1 summarizes the introduced fueling accuracy errors and the corrections. The fueling accuracy errors hereafter are denoted by:

$$\Theta=[\theta_1\ \theta_2 \ldots \theta_m]' \tag{24}$$

In this illustrating example, m=10. The typical error range of each error is shown below in Table 1:

TABLE 1

Accuracy errors and fueling rate correction data in the illustrating example

| | Symbol | Alternative Symbol | Error Range |
|---|---|---|---|
| Uncertainty Description | | | |
| Charge est. gain Error | $\Delta G_{\dot{m}_c}$ | $\theta_1$ | [−5%, 5%] |
| Charge est. offset error | $\Delta B_{\dot{m}_c}$ | $\theta_2$ | [−0.1, 0.1] kg/s |
| IMP Sensing gain error | $\Delta G_{P_{im}}$ | $\theta_3$ | [−10%, 10%] |
| IMP Sensing offset error | $\Delta B_{P_{im}}$ | $\theta_4$ | [−0.1, 0.1] Bar |
| IMT Sensing gain error | $\Delta G_{T_{im}}$ | $\theta_5$ | [−10%, 10%] |
| IMT Sensing offset error | $\Delta B_{T_{im}}$ | $\theta_6$ | [−30, 30] K |
| $1^{st}$ Fueling gain error | $\Delta G_{\dot{m}_{f1}}$ | $\theta_7$ | [−5%, 5%] |
| $2^{nd}$ Fueling gain error | $\Delta G_{\dot{m}_{f2}}$ | $\theta_8$ | [−5%, 5%] |
| Total Fueling offset error | $\Delta B_{\dot{m}_{f1}}$ + $\Delta B_{\dot{m}_{f2}}$ | $\theta_9$ | [−0.005, 0.005] kg/s |
| AFR offset error | $\Delta B_{AFR}$ | $\theta_{10}$ | [−0.1, 0.1] |
| Adaptive corr. term description | | | |
| 1st fueling correction term | $\Delta_{f1}$ | | |
| 2nd fueling correction term | $\Delta_{f2}$ | | |

At step 304, the controller 202 derives a plurality of regressors (ϕ) corresponding to the plurality of accuracy errors (Θ). For example, by applying Taylor series expansion to the fueling uncertainty model introduced by Eq. (7) at the nominal condition ($\theta_i$=0 and $\Delta_{fj}$=0, ∀i,j), the controller 202 may determine the below equation $$\lambda_{meas} = \lambda_{\theta_i=\Delta_{fj}=0} + \sum_{i=1}^{m} \frac{\partial \lambda_{meas}}{\partial \theta_i} * \theta_i + \sum_{j=1}^{n} \frac{\partial \lambda_{meas}}{\partial \Delta_{fj}} \Delta_{fj} + H.O.T. \tag{25}$$

where m=10 and n=2 in the illustrating example. In Eq. (25), $\lambda_{\theta_i=\Delta_{fj}=0}$ stands for the resulting lambda when all the fueling accuracy errors and fueling rate correction data are equal to zeros. Thus, the resulting lambda $\lambda_{\Theta_i=\Delta_{fj}=0}$ is $\lambda_{des}$ at the nominal condition according to Eq. (1). By neglecting the high order terms (H. O. T.) of the expansion, $\lambda_{meas}$ can be approximated by:

$$\lambda_{meas} \approx \lambda_{des} + \sum_{i=1}^{m} \frac{\partial \lambda_{meas}}{\partial \theta_i} * \theta_i + \sum_{j=1}^{n} \frac{\partial \lambda_{meas}}{\partial \Delta_{fj}} \Delta_{fj} \tag{26}$$

In Eq. (26), $$\sum_{i=1}^{m} \frac{\partial \lambda_{meas}}{\partial \theta_i} * \theta_i$$

is the lambda deviation caused by the fueling accuracy errors Θ and $$\sum_{j=1}^{n} \frac{\partial \lambda_{meas}}{\partial \Delta_{fj}} \Delta_{fj}$$

is the lambda deviation caused by the proposed fueling rate correction data $\Delta_f$. The controller 202 uses Eq. 26 to determine $\Delta_{fj}$ such that the fueling rate correction data cancel out the effect of the fueling accuracy errors on lambda deviation and thus, the true lambda $\lambda_{meas}$ is equal or close to its desired value $\lambda_{des}$.

For example, the controller 202 may derive the equation (27) below $$\sum_{i=1}^{m} \frac{\partial \lambda_{meas}}{\partial \theta_i} * \theta_i + \sum_{j=1}^{n} \frac{\partial \lambda_{meas}}{\partial \Delta_{fj}} \Delta_{fj} = 0 \tag{27}$$

using suitable fueling rate correction data $\Delta_f$, which consists of the first fueling rate correction term $\Delta_{f1}$ and the second first fueling rate correction term $\Delta_{f2}$ in the illustrating example. If Eq. (27) holds, then according to Eq. (26), $\lambda_{meas}$ is equal or close to its desired value $\lambda_{des}$.

$$\lambda_{meas} - \lambda_{des} \approx 0 \tag{28}$$

The partial derivatives of $\lambda_{meas}$ with respect to fueling accuracy errors $\Theta$ are denoted by $\phi$ and named regressors hereafter, $$\Phi = [\Phi_1\ \Phi_2\ \ldots\ \Phi_m]' = \left[\frac{\partial \lambda_{meas}}{\partial \theta_1}\ \frac{\partial \lambda_{meas}}{\partial \theta_2}\ \ldots\ \frac{\partial \lambda_{meas}}{\partial \theta_m}\right]' \tag{29}$$

Further, the lambda deviation caused by fueling accuracy errors can be written into a vector form given below $$\sum_{i=1}^{m} \frac{\partial \lambda_{meas}}{\partial \theta_i} * \theta_i = \Phi'\Theta \tag{30}$$

For the illustrating example, a full expansion of $\phi'\Theta$ is $$\begin{aligned}\Phi'\Theta = {} & \frac{1+\lambda_{des}\overline{AFR}_S}{\overline{AFR}_S}\theta_1 + \frac{1+\lambda_{des}\overline{AFR}_S}{\overline{AFR}_S\hat{m}_c}\theta_2 + \frac{1+\lambda_{des}\overline{AFR}_S}{\overline{AFR}_S}(1+\hat{P}_{im}K_P)\theta_3 + \\ & \frac{1+\lambda_{des}\overline{AFR}_S}{\overline{AFR}_S}\left(\frac{1}{\hat{P}_{im}} + K_P\right)\theta_4 + \frac{1+\lambda_{des}\overline{AFR}_S}{\overline{AFR}_S}(-1+\hat{T}_{im}K_T)\theta_5 + \\ & \frac{1+\lambda_{des}\overline{AFR}_S}{\overline{AFR}_S}\left(-\frac{1}{\hat{T}_{im}} + K_T\right)\theta_6 + \frac{1+\lambda_{des}\overline{AFR}_S}{\overline{AFR}_S}(-(1-r))\theta_7 + \\ & \frac{1+\lambda_{des}\overline{AFR}_S}{\overline{AFR}_S}(-r)\theta_8 + \left(-\frac{1+\lambda_{des}\overline{AFR}_S{}^2}{\overline{AFR}_S\hat{m}_c}\right)\theta_9 + \left(-\frac{\lambda_{des}}{\overline{AFR}_S}\right)\theta_{10}\end{aligned} \tag{31}$$

where $K_P$ and $K_T$ are the terms from the partial derivative of $\eta_{vol}$, given by $$K_P = \frac{a_2 + 2a_4\hat{P}_{im} + a_5\hat{N}_e}{a_0 + a_1\hat{N}_e + a_2\hat{P}_{im} + a_3\hat{N}_e^2 + a_4\hat{P}_{im}^2 + a_5\hat{N}_e\hat{P}_{im}} \tag{32}$$

$$K_T = \frac{a_7 + 2a_8\hat{T}_{im}}{a_6 + a_7\hat{T}_{im} + a_8\hat{T}_{im}^2} \tag{33}$$

The identified accuracy errors $\Theta$ may have different units varying from pressure, temperature, percentage, fraction, etc. The numerical range of each $\theta_i$ may be largely different. In some examples, the accuracy errors and regressors are normalized such that $$\phi'\Theta = \overline{\phi}'\overline{\Theta} \tag{34}$$

and $$\overline{\Theta} = [\overline{\theta}_1\ \overline{\theta}_2\ \ldots\ \overline{\theta}_m]',\ \overline{\theta}_i \in [-1, 1],\ \forall i \tag{35}$$

Further, $\phi$ and $\Theta$ used below may stand for their normalized values.

At step 306, the controller 202 calibrates an engine (e.g., engine and/or generator 220) by determining (e.g., estimating) the accuracy errors ($\Theta$) based on the regressors ($\phi$) and lambda measurements from a lambda sensor (e.g., offline calibration of the engine 220). For example, the engine (e.g., 220) may run at multiple different operating parameters (e.g., conditions) such as at various engine speeds, different loads, lambda setpoints, and/or fueling command ratios. The controller 202 may set the operating parameters of the engine 220 and measure the lambda at the steady state of each operating condition. Using the lambda measurements at the different operating parameters, the controller 202 may determine the plurality of accuracy errors. By calculating, determining, and/or estimating the accuracy errors during the calibration process (e.g., step 306), the controller 202 may use the estimated accuracy errors to adjust the fueling commands to correct for errors in the fueling rates of the fueling system 220 during run-time even when the lambda measurements are unavailable. A lambda scouting may be needed to assist in initial engine start for the calibration.

In some examples, the controller 202 may use an optimization equation, algorithm, and/or function (e.g., a least square optimization) to determine the plurality of accuracy errors for the engine 220. In some examples, depending on the engine 220, the controller 202 may calibrate the engine 220 using different (e.g., additional and/or less) accuracy errors than the ones described at step 302. For example, for certain engines 220, the controller 202 might not use any gain errors and/or offset errors. Additionally, and/or alternatively, for certain engines 220, the controller 202 might not use the intake manifold pressure and/or temperature gain/offset errors. Additionally, and/or alternatively, for certain engines 220, the controller 202 may use additional errors not listed above to calibrate the engine.

In some examples, if the fueling rate correction terms from the data are set to zero in Eq. (26), meaning nominal fueling commands are used, then $$\lambda_{meas} - \lambda_{des} = \phi'\Theta \tag{36}$$

Eq. (36) indicates the relation between the lambda error and the identified accuracy errors $\Theta$ with nominal fueling commands, which can be used in offline calibration to estimate the accuracy errors $\Theta$ by measuring $\lambda_{meas} - \lambda_{des}$ and $\phi$ across engine operating range. Based on Eq. (36), the controller 202 determines the $\Theta$ estimation problem as follows: Find $\hat{\Theta}$ such that the norm of $(\lambda_{meas} - \lambda_{des} - \phi'\hat{\Theta})$ across the complete operating range is minimized. In other words, the controller 202 determines a set of estimated accuracy errors such that:

$$\min_{\hat{\Theta}} |X - Y\hat{\Theta}| \tag{37}$$

where $X \epsilon R^k$ is a numerical vector evaluating lambda errors and $Y \epsilon R^{k \times m}$ is a numerical matrix evaluating $\phi'$ at all the k operating points. $\phi$ only contains nominal parameters that are available for computing Y, such as estimation, sensor readings, desired lambda, etc. In the illustrating example, $\phi=\phi(\hat{P}_{im}, \hat{T}_{im}, \hat{m}_c, \widehat{AFR}_S, \lambda_{des}, r)$.

In some examples, the calibration can also be done in steady state during on-line operation when lambda measurements are available. In such examples, the lambda deviation caused by fueling rate correction data $\Delta_f$, referring to Eq. (26), may also need to be taken into account in estimating accuracy errors.

Figure 5:
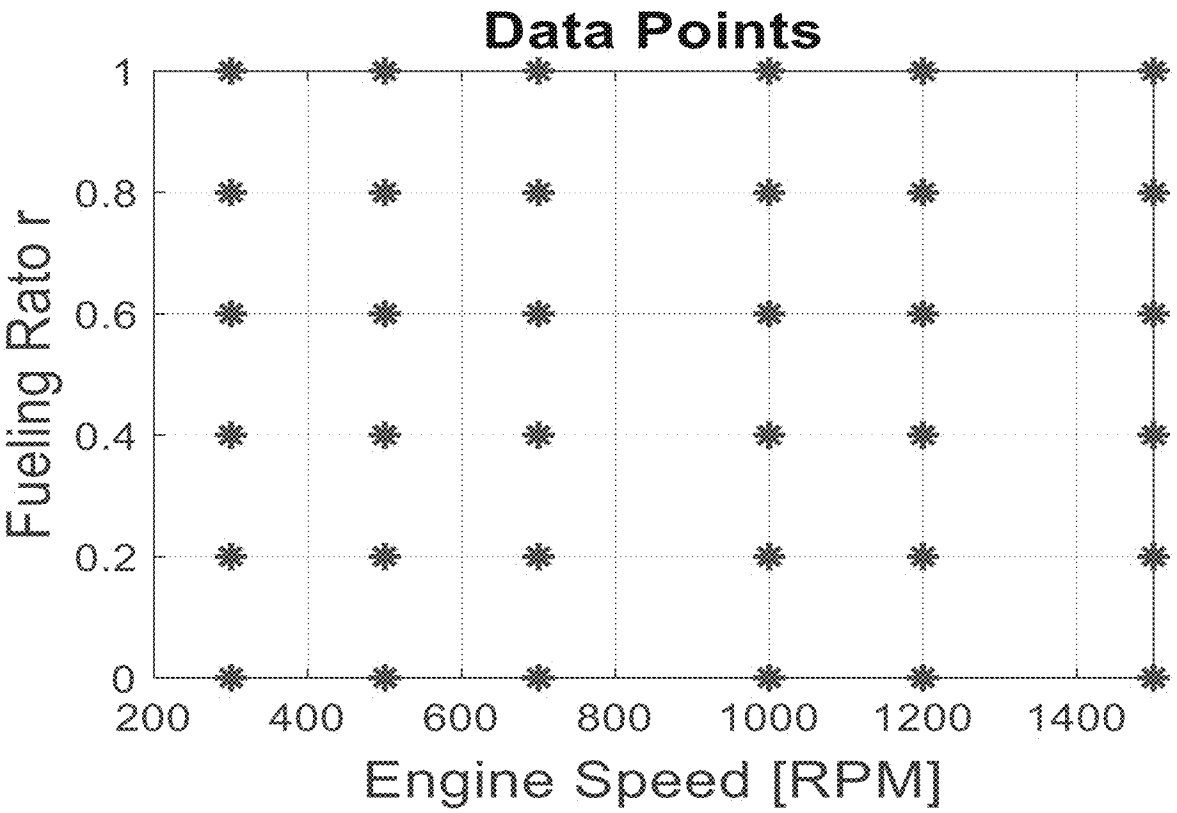
FIG. 5 shows engine calibration data points used for accuracy error estimation.

FIG. 5 shows operating parameter data points used to determine the accuracy errors in the illustrating example. There are k=36 data points representing varying engine speeds and $2^{nd}$ fueling ratios. For instance, the controller 202 may set the operating parameters for the fueling ratio at [0, 0.2, 0.4, 0.6, 0.8, and 1]. For each of the fueling ratios, the controller 202 may set the engine speed at [300, 500, 700, 1000, 1200, 1500]. Further, the controller 202 may set the desired lambda at 1. Using these 36 data points, the controller 202 may receive the lambda measurements at each point. Further, the controller 202 may measure, estimate, and/or determine the intake manifold pressure (kilo pascals (kpa)), the intake manifold temperature (Kelvin (K)), the charge flow rate estimation (kg/s), and/or the secondary fueling rate command ratio to calculate $\phi$.

Figure 6:
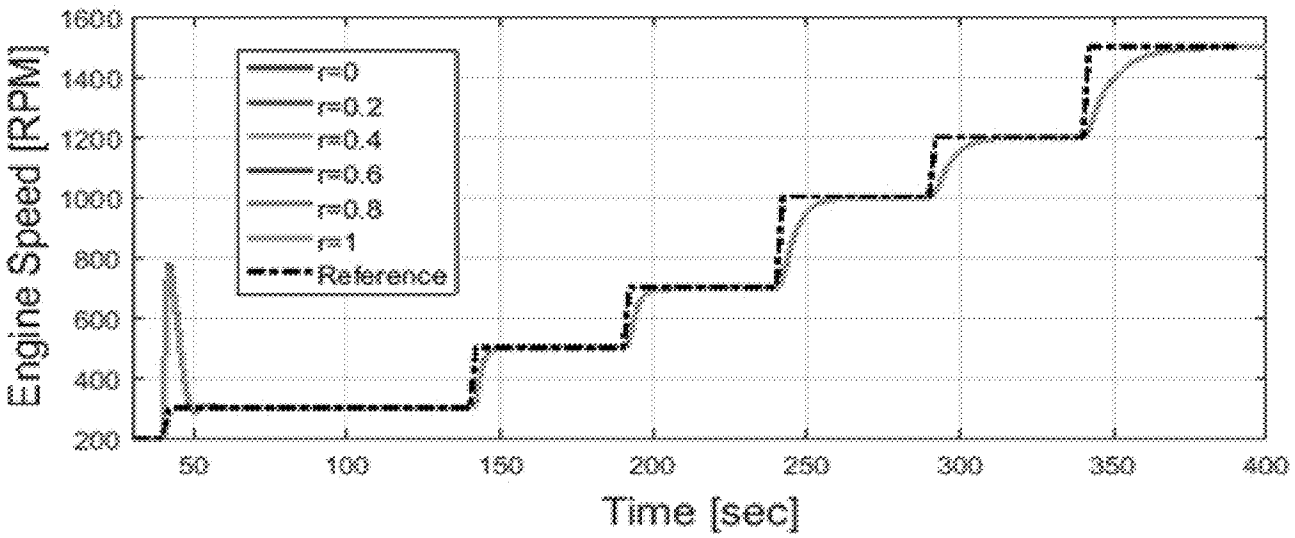
FIG. 6 shows graphical representations of lambda errors at the engine calibration data points.
Figure 6:
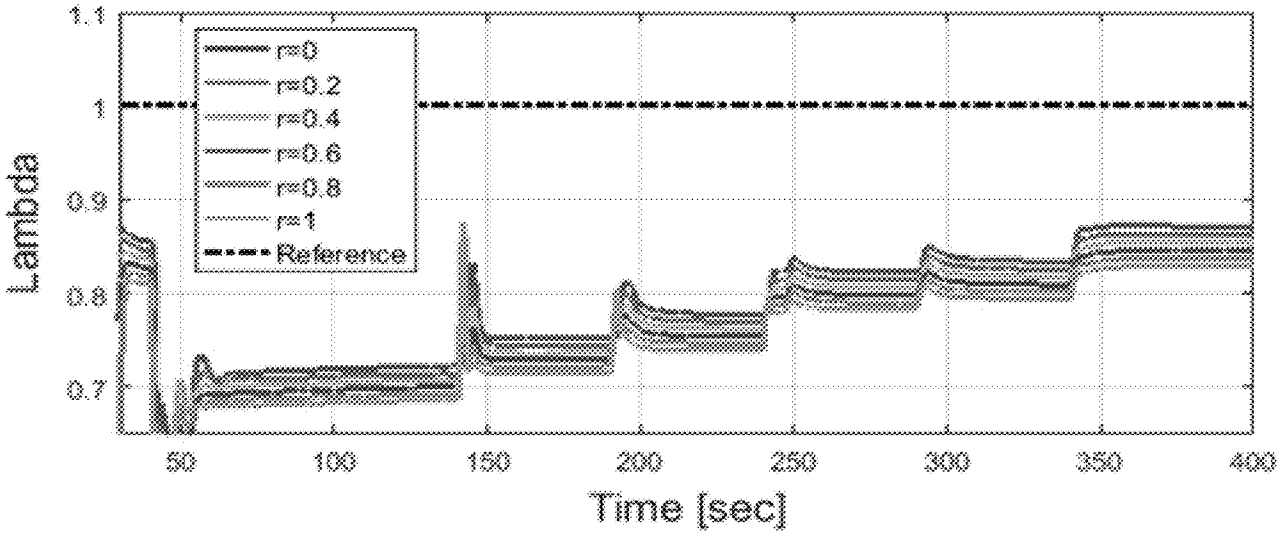

Referring to Eq. (37), X comes out to be a 36-by-1 vector and Y comes out to be a 36-by-10 matrix denoting 36 data points on the data points map and 10 fueling accuracy errors. FIG. 6 shows the $\lambda_{meas}$ and $\lambda_{des}$ at 36 data points from FIG. 5 when the fueling is subjected to the accuracy errors artificially introduced in FIG. 2, in which IMP sensing error=+10Pa and $2^{nd}$ Fueling error=+5%, which translates to the normalized accuracy errors $\theta_4=1$ and $\theta_8=1$.

Figure 7:
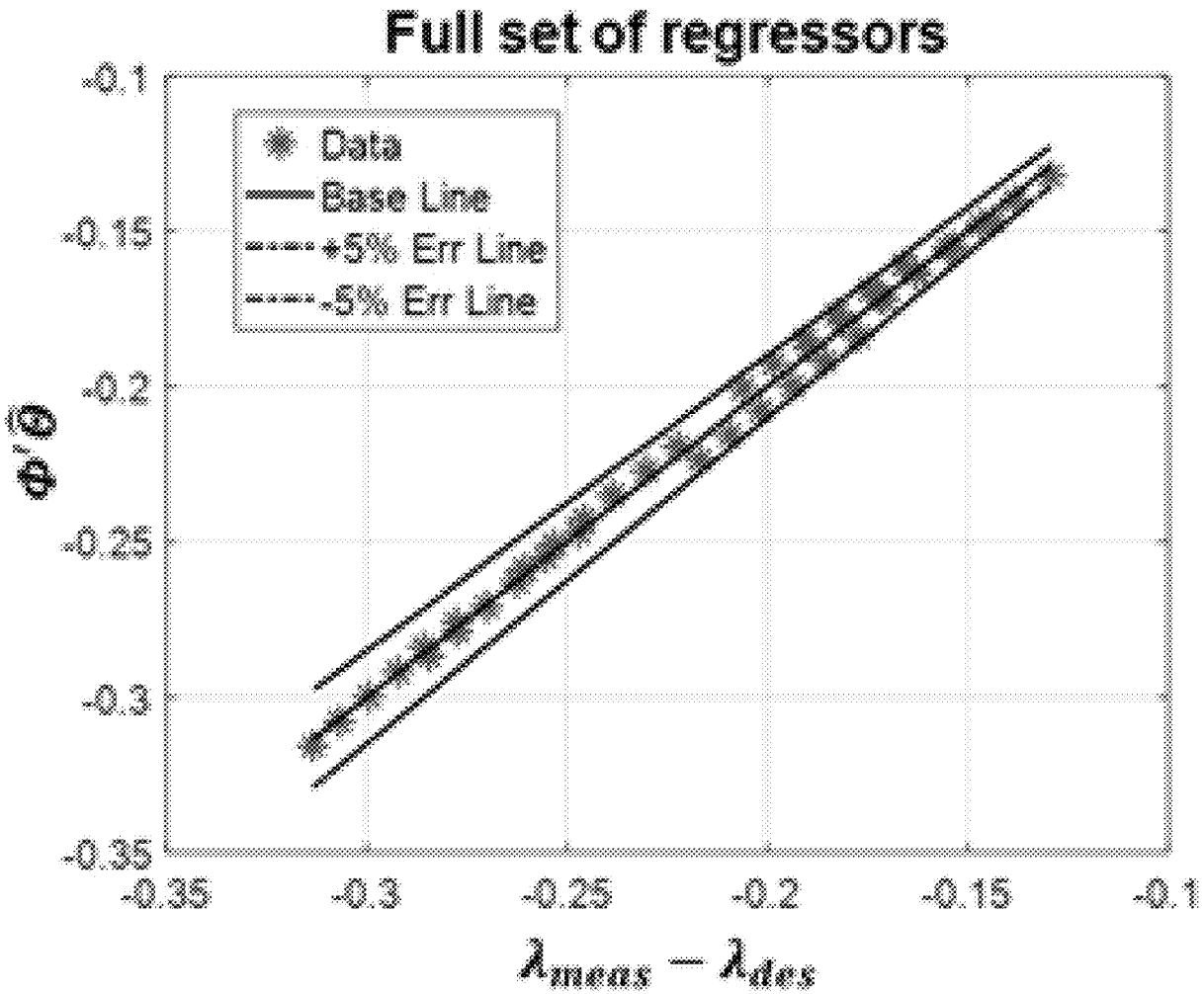
FIG. 7 shows a graphical representation of an estimation of accuracy errors using a full set of regressors.

FIG. 7 shows the lambda deviation estimation using estimated accuracy errors $\hat{\Theta}$ in the illustrating example. The error between the actual lambda error $\lambda_{meas}-\lambda_{des}$ and its estimation $\phi'\hat{\Theta}$ are within 5% error range. The estimated accuracy errors are $$\hat{\Theta} = \begin{bmatrix} \hat{\theta}_1 \\ \hat{\theta}_2 \\ \hat{\theta}_3 \\ \hat{\theta}_4 \\ \hat{\theta}_5 \\ \hat{\theta}_6 \\ \hat{\theta}_7 \\ \hat{\theta}_8 \\ \hat{\theta}_9 \\ \hat{\theta}_{10} \end{bmatrix} = \begin{bmatrix} -0.7652 \\ 0.0036 \\ 0.0645 \\ 0.9929 \\ -0.3405 \\ 0.1787 \\ 0.7542 \\ -0.0683 \\ -0.0010 \\ 0.0974 \end{bmatrix} \tag{38}$$

In some examples, such as in Eq. (38), $\hat{\theta}_4=0.9929$ closely matches the value of its corresponding imposed accuracy error $\theta_4$. However, other accuracy errors, such as $\hat{\theta}_8=-0.0683$, might not match the corresponding imposed accuracy error $\theta_8$. This may mean some of the uncertainties might not be observable, but the overall estimation performance is still good enough across the engine operating range.

At step 308, the controller 202 determines (e.g., derives) fueling rate correction data equations ($\Delta$) based on $\phi$ and/or the determined $\hat{\Theta}$. The fueling rate correction data indicates correction terms for each of the fueling valves. The correction terms are used to cancel out the effect of the plurality of accuracy errors such that the lambda value within the engine 220 is substantially similar to the desired lambda value even when lambda feedback is not available.

$\Theta$ is estimated by $\hat{\Theta}$ as described at step 306. Then, $\hat{\Theta}$ can be used to substitute $\Theta$ in Eq. (27), as rewritten below $$\Phi'\hat{\Theta} + \sum_{j=1}^{n} \frac{\partial \lambda_{meas}}{\partial \Delta_{fj}} \Delta_{fj} = 0 \tag{39}$$

For the illustrating example, the expansion of the correction terms in Eq. (39) is $$\sum_{j=1}^{2} \frac{\partial \lambda_{meas}}{\partial \Delta_{fj}} \Delta_{fj} = -\frac{1+\lambda_{des}\widehat{AFR}_S}{\widehat{AFR}_S}((1-r)\Delta_{f1} + r\Delta_{f2}) \tag{40}$$

Eq. (41) is obtained by combining Eqs. (39) and (40), $$(1-r)\Delta_{f1} + r\Delta_{f2} = \frac{\widehat{AFR}_S}{1+\lambda_{des}\widehat{AFR}_S}\Phi'\hat{\Theta} \tag{41}$$

Eq. (41) should be held all the time regardless the value of the r. Therefore, the first fueling rate correction term ($\Delta_{f1}$) equation can be obtained by setting r=0, meaning the moment the fuel is solely injected by $1^{st}$ fuel valve, $$\Delta_{f1} = \frac{\widehat{AFR}_S}{1+\lambda_{des}\widehat{AFR}_S}\Phi'(r=0)\hat{\Theta} \tag{42}$$

Similarly, the second fueling rate correction term ($\Delta_{f2}$) equation can be obtained by setting r=1, meaning the moment the fuel is solely injected by $2^{nd}$ fuel valve, $$\Delta_{f2} = \frac{\widehat{AFR}_S}{1+\lambda_{des}\widehat{AFR}_S}\Phi'(r=1)\hat{\Theta} \tag{43}$$

The explicit forms of the fueling rate correction data equations $\Delta_{f1}$ and $\Delta_{f2}$ in the illustrating example are given below in Eq. (44) and (45)

$$\begin{aligned}\Delta_{f1} = \hat{\theta}_1 + \frac{1}{\hat{m}_c}\hat{\theta}_2 + (1+\hat{P}_{im}K_P)\hat{\theta}_3 + \\ \left(\frac{1}{\hat{P}_{im}} + K_P\right)\hat{\theta}_4 + (-1+\hat{T}_{im}K_T)\hat{\theta}_5 + \left(-\frac{1}{\hat{T}_{im}} + K_T\right)\hat{\theta}_6 + \\ (-1)\hat{\theta}_7 + \left(-\frac{1+\lambda_{des}\widehat{AFR}_S}{\hat{m}_c}\right)\hat{\theta}_9 + \left(-\frac{\lambda_{des}}{1+\lambda_{des}\widehat{AFR}_S}\right)\hat{\theta}_{10}\end{aligned} \tag{44}$$

$$\begin{aligned}\Delta_{f2} = \hat{\theta}_1 + \frac{1}{\hat{m}_c}\hat{\theta}_2 + (1+\hat{P}_{im}K_P)\hat{\theta}_3 + \\ \left(\frac{1}{\hat{P}_{im}} + K_P\right)\hat{\theta}_4 + (-1+\hat{T}_{im}K_T)\hat{\theta}_5 + \left(-\frac{1}{\hat{T}_{im}} + K_T\right)\hat{\theta}_6 + \\ (-1)\hat{\theta}_8 + \left(-\frac{1+\lambda_{des}\widehat{AFR}_S}{\hat{m}_c}\right)\hat{\theta}_9 + \left(-\frac{\lambda_{des}}{1+\lambda_{des}\widehat{AFR}_S}\right)\hat{\theta}_{10}\end{aligned} \tag{45}$$

At step 310, the controller 202 determines (e.g., derives) corrected fueling commands equations based on the fueling rate correction data. For example, after determining the fueling rate correction data (e.g., $\Delta_{f1}$ and $\Delta_{f2}$), the controller 202 corrects a fueling rate command for the fueling valves with the fueling rate correction data (e.g., correcting the nominal fueling command using the fueling rate correction data).

In other words, during the calibration process, the controller 202 calibrates the engine 220 using the lambda sensor by finding the accuracy errors within the system 200. For example, the system 200 may have an IMP and/or IMT sensing offset error that is present for the particular engine 220. The controller 202 may determine the sensing offset errors during the calibration process by using the lambda measurements. Then, during run-time, these accuracy errors (e.g., the sensing offset errors) may still be present. The controller 202 determines/uses fueling rate correction data and/or corrected fueling commands for the valves to account for the presence of these accuracy errors that were determined during the calibration process. The lambda measurements are only required in the calibration process in determining the accuracy errors. During run-time, corrected fueling commands are computed based on the determined accuracy errors, which do not rely on the lambda measurement from the lambda sensor. Therefore, corrected fueling commands are still implementable even when lambda measurements are not available in some time during run-time such as engine start-up phases.

In some examples, $\Delta_f$ is calculated at step 308 and then the corrected fueling commands can be constructed according to Eq. (5). For the illustrating example, the two corrected fueling commands are explicitly given below $$\hat{m}^*_{f1} = \hat{m}_{f1}\left\{1 + \hat{\theta}_1 + \frac{1}{\hat{m}_c}\hat{\theta}_2 + (1 + \hat{P}_{im}K_P)\hat{\theta}_3 + \left(\frac{1}{\hat{P}_{im}} + K_P\right)\hat{\theta}_4 + (-1 + \hat{T}_{im}K_T)\hat{\theta}_5 + \left(-\frac{1}{\hat{T}_{im}} + K_T\right)\hat{\theta}_6 + (-1)\hat{\theta}_7 + \left(-\frac{1 + \lambda_{des}\widehat{AFR}_S}{\hat{m}_c}\right)\hat{\theta}_9 + \left(-\frac{\lambda_{des}}{1 + \lambda_{des}\widehat{AFR}_S}\right)\hat{\theta}_{10}\right\} \tag{46}$$

$$\hat{m}^*_{f2} = \hat{m}_{f2}\left\{1 + \hat{\theta}_1 + \frac{1}{\hat{m}_c}\hat{\theta}_2 + (1 + \hat{P}_{im}K_P)\hat{\theta}_3 + \left(\frac{1}{\hat{P}_{im}} + K_P\right)\hat{\theta}_4 + (-1 + \hat{T}_{im}K_T)\hat{\theta}_5 + \left(-\frac{1}{\hat{T}_{im}} + K_T\right)\hat{\theta}_6 + (-1)\hat{\theta}_8 + \left(-\frac{1 + \lambda_{des}\widehat{AFR}_S}{\hat{m}_c}\right)\hat{\theta}_9 + \left(-\frac{\lambda_{des}}{1 + \lambda_{des}\widehat{AFR}_S}\right)\hat{\theta}_{10}\right\} \tag{47}$$

At step 312, the controller 202 stores the corrected fueling command equations from step 310, the estimated accuracy errors from step 306, and/or the fueling rate correction data equations from step 308 in memory 225. In some instances, the fueling command adaptive correction unit 240 may perform the steps from method 300 (e.g., 302-310) and then store the results, such as the equations, accuracy errors, corrected fueling commands, and/or correction terms in memory 225. Then, as described below in method 400, the controller 202 may use the correction terms (e.g., Eq. 42 and Eq. 43) and/or estimated accuracy errors to generate corrected fueling commands according to Eq. (5) for controlling the engine 220.

FIG. 4 shows an exemplary flowchart (e.g., method) 400 for executing corrected fueling commands during run time. In operation, at step 402, the controller 202 calibrates the engine 220 operating in a steady-state mode by determining a plurality of accuracy errors associated with a fueling rate based on a plurality of measurements associated with a lambda sensor. In other words, as described above in FIG. 3, the controller 202 may determine the estimated plurality of accuracy errors in step 306. This may be performed when the engine 220 is operating in an off-line or developmental mode and/or when the engine 220 is in a steady-state during online operation. Then, the controller 202 may store the estimated plurality of accuracy errors in memory 225. At step 402, the controller 202 may calibrate the engine 220 by retrieving the estimated plurality of accuracy errors from memory 225.

At step 404, the controller 202 may determine fueling rate correction data (e.g., first and second correction terms) during on-line operation of the engine 220 based on the plurality of accuracy errors. The on-line operation of the engine may be when the engine 220 is providing power to a load and/or include a time period that the engine is operating in a transient state mode and another time period that the engine is operating in a steady-state mode. For example, the engine 220 may be in a transient state mode when the engine 220 is ramping up, ramping down, start-up, cranking, and/or shutting down. If the engine 220 is not in the transient state mode, the engine 220 may be in a steady-state mode. For example, in some instances, the engine 220 is in a transient mode when the engine 220 is ramping up (e.g., cranking or starting up). Then, the engine 220 is in a steady state mode for a period of time. After, the engine 220 is back in the transient mode when the engine 220 is ramping down (e.g., shutting down).

In other words, the controller 202 may retrieve the fueling rate correction data equations (e.g., Eqs. 42, 43, 44, and/or 45) determined at step 308 above. The controller 202 may also measure parameters from the sensors 212 such as engine speed, IMP, IMT, etc. The controller 202 may use these parameters to calculate the regressors ($\phi$) for the fueling rate correction data equations. Then, the controller 202 may determine fueling rate correction data based on the accuracy errors from step 402, the measured parameters from the sensors 212, and the fueling rate correction data equations from block 308.

At step 406, the controller 202 controls the fuel valve(s) 214 during on-line operation of the engine 220 using corrected fueling commands $\hat{m}^*_f$. The corrected fueling commands may be based on the fueling rate correction data from step 404.

In other words, the controller 202 may retrieve the corrected fueling command equations (e.g., Eqs. 46 and 47) from the memory 225. The controller 202 may also determine the nominal fueling commands as described above and/or based on Eq. 4. Then, based on the nominal fueling commands, the corrected fueling command equations, and the fueling rate correction data from step 404, the controller 202 may determine the corrected fueling commands. The corrected fueling commands may be for one or more valves. For example, the controller 202 may use Eq. 46 to determine a first fueling command for the first valve of the fuel control valves 214. The controller 202 may use Eq. 47 to determine a second fueling command for the second valve of the fuel control valves 214. After, the controller 202 may use the determined fueling command(s) to control the fuel valves 214 during on-line operation of the engine 220.

Additionally, and/or alternatively, the computation of fueling correction data $\Delta_f$ and the corrected fueling commands $\hat{m}^*_f$ in on-line operation of the engine 220 might not require lambda measurements from a lambda sensor if off-line calibration is adopted. Thus, they can be used to effectively to eliminate or reduce the steady state error in lambda induced by fueling accuracy errors even when lambda feedback is unavailable in some scenarios.

In other words, when the engine 220 is at a steady state (e.g., off-line mode or after a ramp up period of during on-line operation), the controller 202 may calibrate an engine to determine the accuracy errors. Then, during a transient mode (e.g., ramp up mode), measurements from the lambda sensor may be unavailable (e.g., inaccurate and/or the lambda sensor is not providing measurements) to the controller 202. The controller 202 may use steps 404 and/or 406 to determine fueling rate correction data and corrected fueling commands to control the fueling valves 214. In some examples, the controller 202 may determine the lambda sensor is unavailable based on an engine start up or shut down command.

Figure 8:
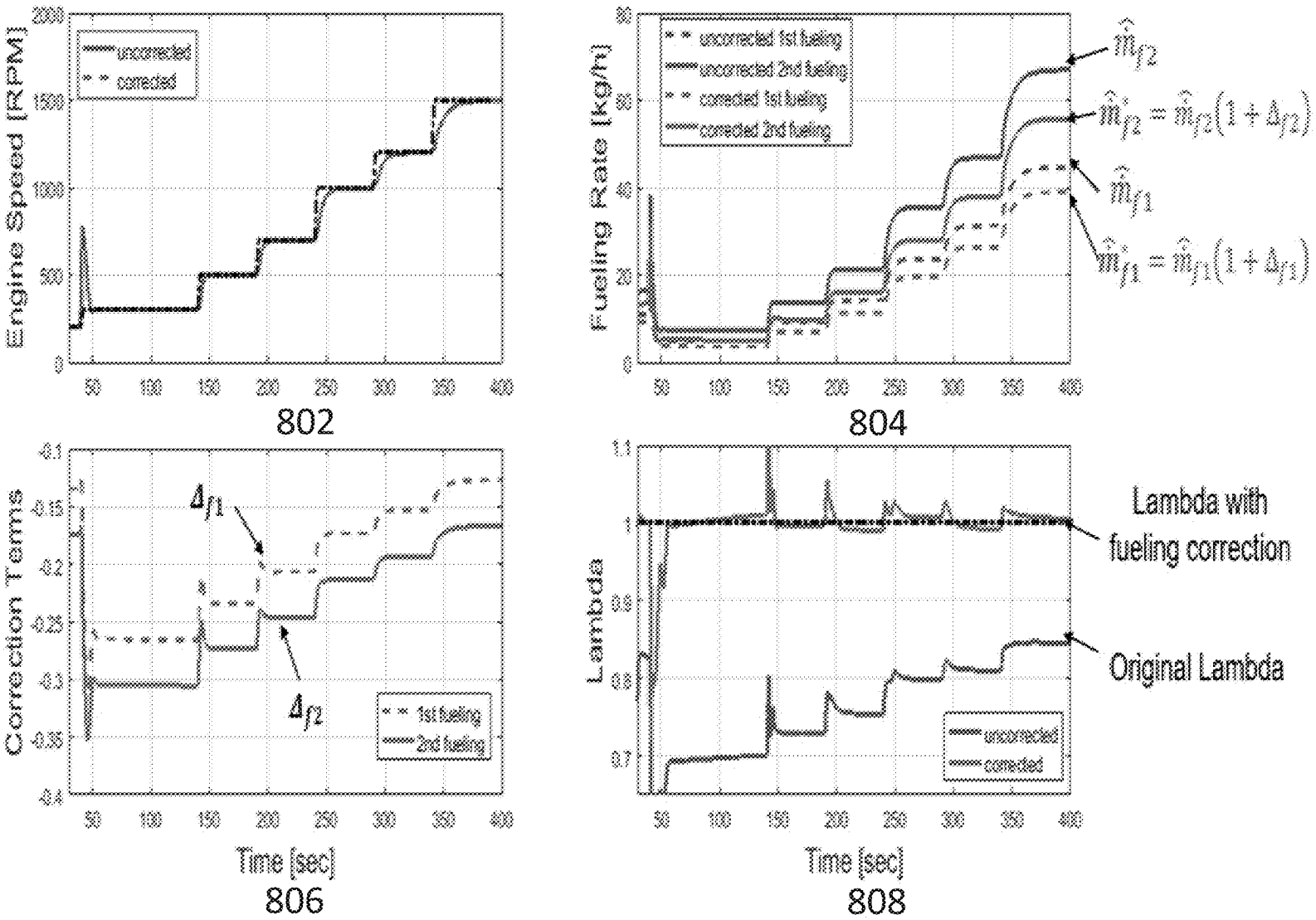
FIG. 8 shows graphical representations of steady state lambda error comparisons with and without fueling correction data.

FIG. 8 shows the steady-state lambda tracking performance for different engine speeds when the fueling is subjected to the accuracy errors artificially introduced in FIG. 3. Graph 802 shows the engine speed profile in which speed varies from 300rpm to 1500rpm covering its entire operating range. Graph 806 shows the fueling rate correction data calculated for $1^{st}$ and $2^{nd}$ fueling commands. Graph 804 shows the nominal and corrected fueling commands for both valves in the system. Graph 808 shows the lambda tracking performance with corrected fueling commands in comparison to that with original nominal fueling commands. In Graph 808, the actual lambda is largely deviated from its desired value $\lambda=1$ with nominal fueling commands, as shown by the curve in blue. This lambda deviation is significantly mitigated when corrected fueling commands are used, as shown by the curve in red.

Figure 9:
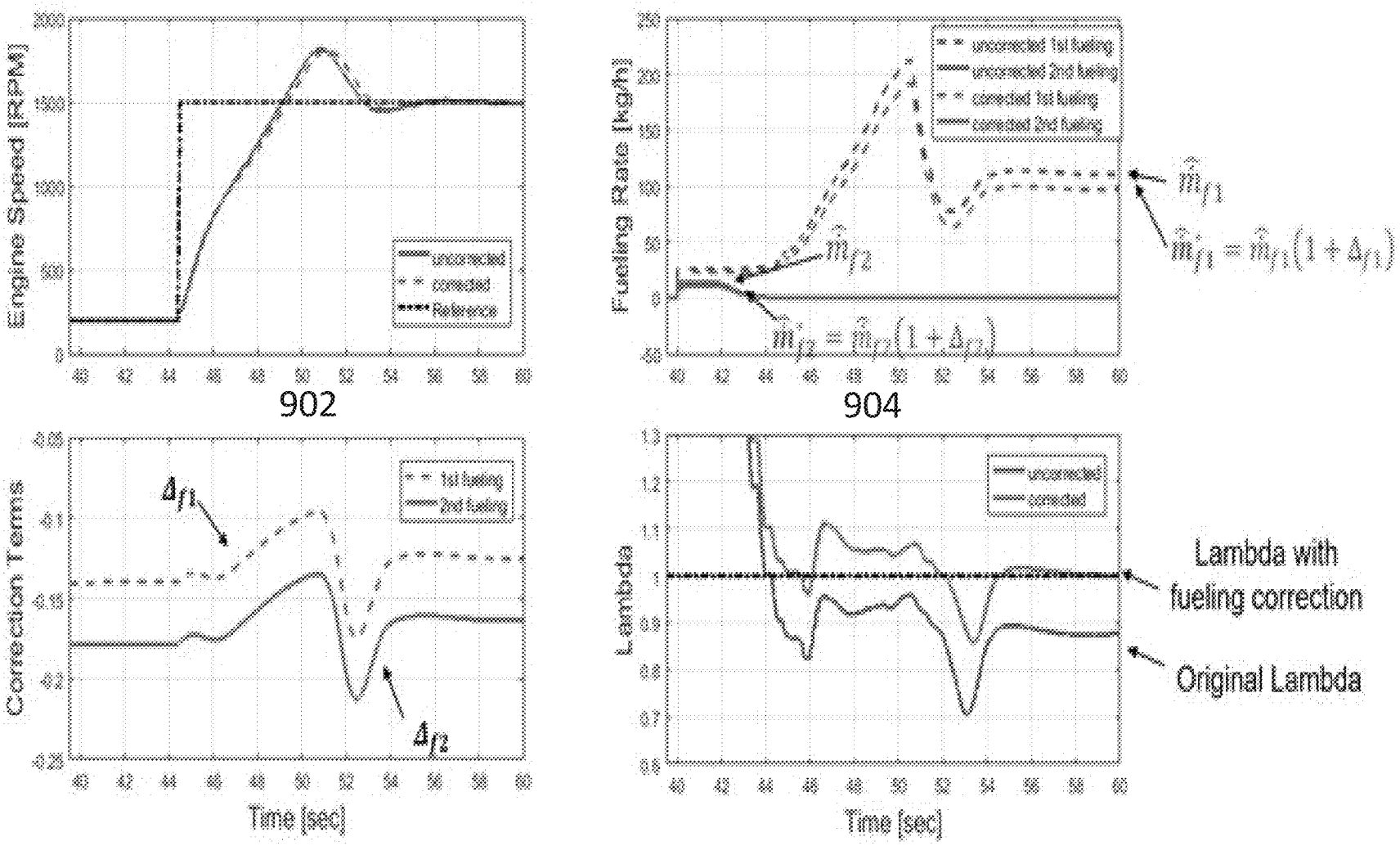
FIG. 9 shows graphical representations of lambda error comparisons in an idealized engine start-up with and without fueling correction data.

FIG. 9 shows an idealized engine start-up procedure. For example, graph 902 shows when engine speed is 200 rpm driven by the starter initially and then ramped up to the rated at 1500rpm. Graph 906 shows the fueling rate correction data calculated for $1^{st}$ and $2^{nd}$ fueling commands during this procedure. Graph 904 shows the nominal and corrected fueling commands for both valves. Graph 908 shows the lambda tracking performance with corrected fueling commands in comparison to that with original nominal fueling commands. Through comparison between with and without corrected fueling commands in graph 1008, the error in lambda is largely mitigated with corrected fueling commands.

Figure 10:
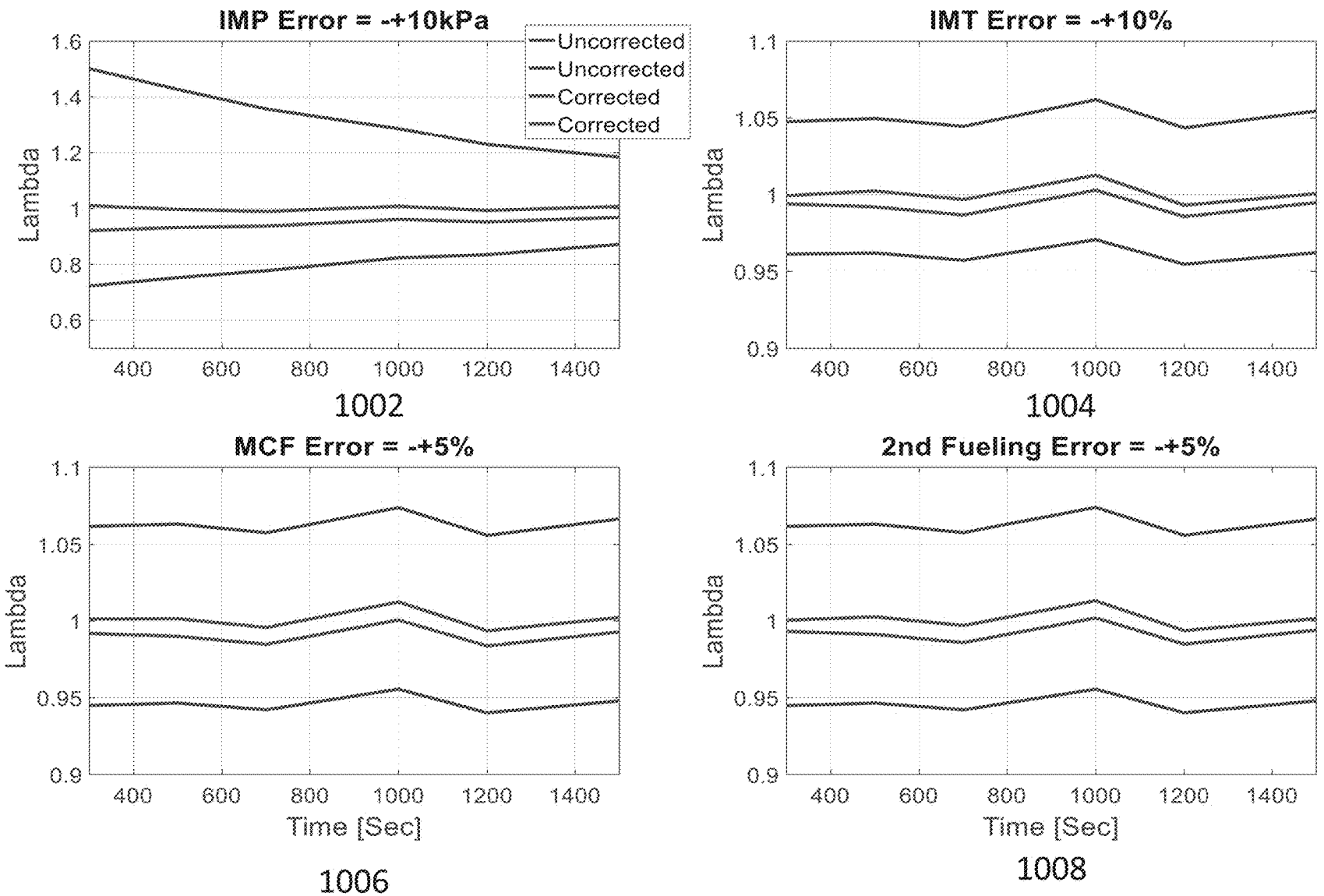
FIG. 10 shows graphical representations of lambda error bands with and without fueling correction data for various engine speeds.

FIG. 10 shows the lambda error band with and without fueling correction for various engine speeds, as the fueling is subjected to various accuracy errors. Graph 1002 shows the error band when IMP sensing errors are within ±10 kPa. Graph 1004 shows the error band when IMT sensing errors are within +10%. Graph 1006 shows the error band when charge estimation errors are within ±5%. Graph 1008 shows the error band when the fueling error for the $2^{nd}$ fuel valve is within ±5%.

Figure 11:
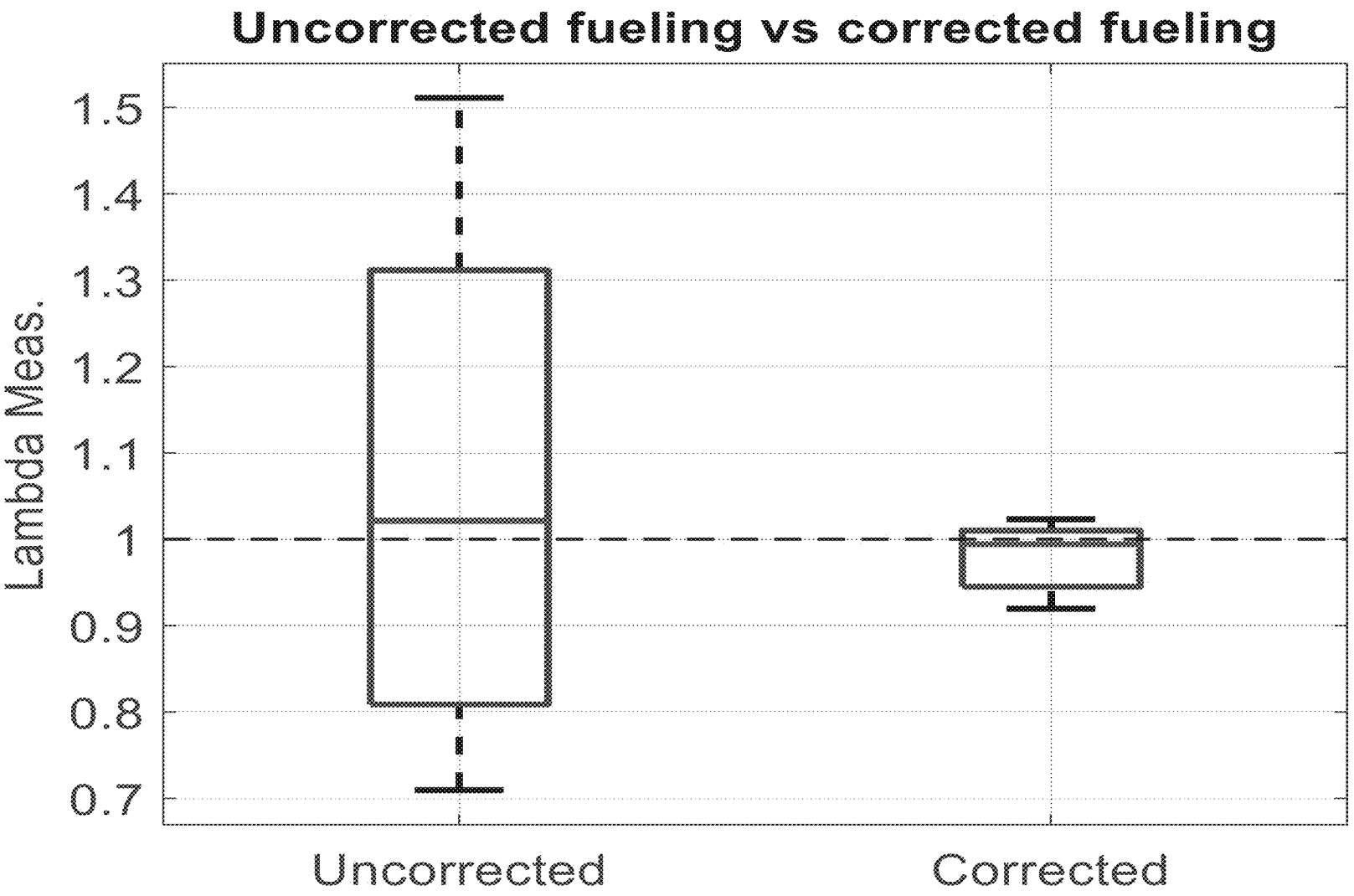
FIG. 11 shows a box plot for lambda errors with and without fueling correction data that combines different fueling accuracy errors.

FIG. 11 shows the lambda error box with and without fueling correction combining various engine speeds and accuracy errors. FIGS. 10 and 11 show that the proposed corrected fueling commands can effectively mitigate the lambda error caused by different accuracy errors in fueling control, as compared to that with nominal fueling commands.

Embodiments of the present disclosure are described by way of example only, with reference to the accompanying drawings. Further, the following description is merely illustrative in nature and is in no way intended to limit the disclosure, its application, or uses. As used herein, the term "unit" or "module" refers to, be part of, or include an Application Specific Integrated Circuit (ASIC), an electronic circuit, a processor or microprocessor (shared, dedicated, or group) and/or memory (shared, dedicated, or group) that executes one or more software or firmware programs, a combinational logic circuit, and/or other suitable components that provide the described functionality. Thus, while this disclosure includes particular examples and arrangements of the units, the scope of the present system should not be so limited since other modifications will become apparent to the skilled practitioner.

It is to be understood that the above description is intended to be illustrative, and not restrictive. Many other embodiments will be apparent to those of skill in the art upon reading and understanding the above description. For example, it is contemplated that features described in association with one embodiment are optionally employed in addition or as an alternative to features described in associate with another embodiment. The scope of the present disclosure should, therefore, be determined with reference to the appended claims, along with the full scope of equivalents to which such claims are entitled.

What is claimed is:

1. A method for correcting fueling commands, comprising:

performing, by a controller, an off-line calibration of an engine operating in a steady-state mode by determining a plurality of accuracy errors associated with a fueling rate based on a plurality of measurements associated with a lambda sensor, wherein the determining of the plurality of accuracy errors is based on a plurality of regressors that are partial derivatives of a fueling uncertainty model calculated with respect to the plurality of accuracy errors as provided by, a developer of the engine prior to the off-line calibration;

determining fueling rate correction data during on-line operation of the engine based on the plurality of accuracy errors that are determined during the off-line calibration; and controlling at least one fueling valve during the on-line operation of the engine using a corrected fueling command, wherein the corrected fueling command is based on the fueling rate correction data.

2. The method of claim 1, wherein the off-line calibration of the engine comprises:

providing one or more commands to cause the engine to operate at a plurality of operating parameters including one or more of: engine speed, engine load, lambda setpoint, or fueling command ratio;

receiving the plurality of measurements at each of the plurality of operating parameters; and calculating the plurality of accuracy errors based on the plurality of measurements.

3. The method of claim 2, wherein the receiving the plurality of measurements comprises receiving the plurality of measurements from the lambda sensor.

4. The method of claim t, wherein at least one of the plurality of accuracy errors is a charge estimation gain error, a charge estimation offset error, an intake manifold pressure (IMP) sensing gain error, an IMP sensing offset error, an intake manifold temperature (IMT) sensing gain error, an IMT sensing offset error, a first valve fueling gain error, a second valve fueling gain error, a total fueling offset error, or a stoichiometric air fuel ratio (AFR) offset error.

5. The method of claim 1, wherein the fueling rate correction data comprises a first fueling rate correction value and a second fueling rate correction value, and wherein the method further comprises:

determining the first fueling rate correction value based on a desired lambda value, the plurality of accuracy errors, a nominal stoichiometric air fuel ratio, and a secondary fueling rate command ratio that is set to zero; and determining the second fueling rate correction value based on the desired lambda value, the plurality of accuracy errors, the nominal stoichiometric air fuel ratio, and the secondary fueling rate command ratio that is set to one.

6. The method of claim 1, wherein the corrected fueling command comprises a first corrected fueling command defined by $$\hat{m}^*_{f1} = \hat{m}_{f1}\left(1 + \frac{\widehat{AFR}_S}{1 + \lambda_{des}\widehat{AFR}_S}\Phi'(r=0)\theta\right),$$

wherein wherein $\hat{m}^*_{f1}$ is the first corrected fueling command, $\hat{m}^*_{f1}$ is a first fueling command based on a desired lambda value, $\widehat{AFR}_S$ is a nominal stoichiometric air fuel ratio, $\lambda_{des}$ is a desired lambda, $\phi'(r=0)$ are a set of coefficients with a secondary fueling rate command ratio set to zero, and $\Theta'$ are the plurality of accuracy errors.

7. The method of claim 1, wherein the corrected fueling command comprises a second corrected fueling command defined by $$\hat{m}^*_{f2} = \hat{m}_{f2}\left(1 + \frac{\widehat{AFR}_S}{1 + \lambda_{des}\widehat{AFR}_S}\Phi'(r=1)\theta\right),$$

wherein $\hat{m}^*_{f2}$ is the second corrected fueling command $\hat{m}^*_{f2}$ is a second fueling command based on a desired lambda value, $\widehat{AFR}_S$ is a nominal stoichiometric air fuel ratio, $\lambda_{des}$ is a desired lambda, $\phi'(r=1)$ are a set of coefficients with a secondary fueling rate command ratio set to one, and $\Theta$ are the plurality of accuracy errors.

8. A system for correcting fueling commands, the system comprising:

an engine and/or generator including one or more fuel control valves;

a pressurized fuel supply configured to provide fuel to the engine and/or generator; and a fuel correction controller in operative communication with the engine and/or generator and the pressurized fuel supply, the thel correction controller configured to:

perform an off-line calibration of the engine and/or generator operating in a steady-state mode by determining a plurality of accuracy errors associated with a fueling rate based, on a plurality of measurements associated with a lambda sensor, wherein the detei-mining of the plurality of accuracy errors is based on a plurality of regressors that are partial derivatives of a fueling uncertainty model calculated with respect to the plurality of accuracy errors as provided by a developer of the engine prior to the off-line calibration;

determine fueling rate correction data during on-line operation of the engine based on the plurality of accuracy errors that are determined during the off-line calibration; and control the one or more fuel control valves during the on-line operation of the engine using a corrected fueling command, wherein the corrected fueling command is based on the fueling rate correction data.

9. The system off claim 8, wherein, to perform the off-line calibration of the engine and/or generator, the fuel correction controller is further configured to:

provide one or more commands to cause the engine to operate at a plurality of operating parameters including one or more of: engine speed, engine load, lambda setpoint, or fueling command ratio;

receive the plurality of measurements at each of the plurality of operating parameters; and calculate the plurality of accuracy errors based on the plurtality of measurements.

10. The system of claim 9, wherein the fuel correction controller receives the plurality of measurements from the lambda sensor.

11. The system of claim 8, wherein at least one of the plurality of accuracy errors is a charge estimation gain error, a charge estimation offset error, an intake manifold pressure (IMP) sensing gain error, an IMP sensing offset error, an intake manifold temperature (IMT) sensing gain error, an IMT sensing offset error, a first valve fueling gain error, a second valve fueling gain error, a total fueling offset error, or a stoichiometric air fuel ratio (AFR) offset error.

12. The system of claim 8, wherein the fueling rate correction data comprises a first fueling rate correction value and a second fueling rate correction value, and wherein the fuel correction controller is further configured to:

determine the first fueling rate correction value based on a desired lambda value, the plurality of accuracy errors, a nominal stoichiometric air fuel ratio, and a secondary fueling rate command ratio that is set to zero, and determine the second fueling rate correction value based on the desired lambda value, the plurality of accuracy errors, the nominal stoichiometric air fuel ratio, and the secondary fueling rate command ratio that is set to one.

13. The system of claim 8, wherein the corrected fueling command comprises a first corrected fueling command defined by $$\hat{m}^*_{f1} = \hat{m}_{f1}\left(1 + \frac{\widehat{AFR}_S}{1 + \lambda_{des}\widehat{AFR}_S}\Phi'(r=0)\theta\right),$$

wherein $\hat{m}^*_{f1}$ is the second corrected fueling command $\hat{m}^*_{f1}$ is a second fueling command based on a desired lambda value, $\widehat{AFR}_S$ is a nominal stoichiometric air fuel ratio, $\lambda_{des}$ is a desired lambda, $\phi'(r=0)$ are a set of coefficients with a secondary fueling rate command ratio set to zero, and $\Theta$ are the plurality of accuracy errors.

14. The system of claim 8, wherein the corrected fueling command comprises a second corrected fueling command defined by $$\hat{m}^*_{f2} = \hat{m}_{f2}\left(1 + \frac{\widehat{AFR}_S}{1 + \lambda_{des}\widehat{AFR}_S}\Phi'(r=1)\theta\right),$$

wherein $\hat{\dot{m}}^*_{f2}$ is the second corrected fueling command $\hat{\dot{m}}^*_{f2}$ is a second fueling command based on a desired lambda value, $\widehat{AFR}_S$ is a nominal stoichiometric air fuel ratio, $\lambda_{des}$ is a desired lambda, $\phi'(r=1)$ are a set of coefficients with a secondary fueling rate command ratio set to one, and $\Theta$ are the plurality of accuracy errors.

15. The system of claim 8, Wherein the corrected fueling command comprise a first fueling command for a first valve of the one or more fuel control valves a second fueling command for a second valve of the one or more fuel control valves.

16. A fuel correction controller for correcting fueling commands, the fuel correction controller configured to:

be in operative communication with an engine and/or generator that includes one or more fuel control valves and with a pressurized fuel supply configured to provide fuel to the engine and/or generator;

perform an off-line calibration of the engine and/or generator operating in a steady-state mode by determining a plurality of accuracy errors associated with a fueling rate based on a plurality of measurements associated with a lambda sensor, wherein the determining of the plurality of accuracy errors is based on a plurality of regressors that are partial derivatives of a fueling uncertainty model calculated with respect to the plurality of accuracy errors as provided by a developer of the engine prior to the off-line calibration;

determine fueling rate correction data during on-line operation of the engine based on the plurality of accuracy errors that are determined during the off-line calibration; and control the one or more fuel control valves during the on-line operation of the engine using a corrected fueling command, wherein the corrected fueling command is based on the fueling rate correction data.

17. The fuel correction controller of claim 16, wherein the fuel correction controller comprises at least one of a stochiometric air-fuel ratio unit, a lambda setpoint determination unit, a charge/air estimator unit, fueling command adaptive correction unit, memory, and a corrected fueling command generation unit.

18. The, fuel correction controller of claim 16, wherein, to perform the off-line calibration of the engine and/or generator, the fuel correction controller is further configured to:

provide one or more commands to cause the engine to operate at a plurality of operating parameters including one or more of: engine speed, engine load, lambda setpoint, or fueling command ratio;

receive the plurality of. easurements at each of the plurality of operating parameters; and calculate the plurality of accuracy errors based on the plurality of measurements, wherein the fuel collection controller receives the plurality of measurements from the lambda sensor.

19. The fuel correction controller of claim 16, wherein at least one of the plurality of accuracy errors is a charge estimation gain error, a charge estimation offset error, an intake manifold pressure (IMP) sensing gain error, an IMP sensing offset error, an intake manifold temperature (IMT) sensing gain error, an IMT sensing offset error, a first valve fueling gain error, a second valve fueling gain error, a total fueling offset error, or a stoichiometric air fuel ratio (AFR) offset error.

20. The fuel correction controller of claim 16, wherein the fueling rate correction data comprises a first fueling rate correction value and a second fueling rate correction value, and wherein the fuel correction controller is further configured to:

determine the first fueling rate correction value based on a desired lambda value, the plurality of accuracy errors, a nominal stoichiometric air fuel ratio, and a secondary fueling rate command ratio that is set to zero: and determine the second fueling rate correction value based on the desired lambda value, the plurality of accuracy errors, the nominal stoichiometric air fuel ratio, and the secondaiy fueling rate command ratio that is set to one.

* * * * *